US009731254B2

(12) United States Patent
Gunia et al.

(10) Patent No.: US 9,731,254 B2
(45) Date of Patent: Aug. 15, 2017

(54) PRODUCING SOLUTIONS FROM CONCENTRATES

(71) Applicant: SudSense, LLC, Miami, FL (US)

(72) Inventors: Nicholas Alexander Gunia, Miami, FL (US); Matthew Karl Gunia, Miami, FL (US); Mark Kurt Gunia, Miami, FL (US); Joel Raymond Chartier, Lakewood Ranch, FL (US); Andrew Paul Muser, St Petersburg, FL (US); Matthew William Vergin, St Petersburg, FL (US); Ryan Carroll Donahue, Sarasota, FL (US); Jason Lee Viera, Bradenton, FL (US); Gerald Joseph Lozinski, Parkland, FL (US); Todd Alan Strobel, Boca Raton, FL (US)

(73) Assignee: SudSense, LLC, Miami, FL (US)

( * ) Notice: Subject to any disclaimer, the term of this patent is extended or adjusted under 35 U.S.C. 154(b) by 0 days.

(21) Appl. No.: 15/404,931

(22) Filed: Jan. 12, 2017

(65) Prior Publication Data

US 2017/0197188 A1 Jul. 13, 2017

Related U.S. Application Data

(60) Provisional application No. 62/277,642, filed on Jan. 12, 2016.

(51) Int. Cl.
*B01F 3/08* (2006.01)
*B01F 7/16* (2006.01)
(Continued)

(52) U.S. Cl.
CPC ..... *B01F 3/0853* (2013.01); *B01F 7/161* (2013.01); *B01F 7/22* (2013.01); *B01F 13/1069* (2013.01);
(Continued)

(58) Field of Classification Search
CPC ..... B01F 3/0853
See application file for complete search history.

(56) References Cited

U.S. PATENT DOCUMENTS 5,797,313 A 8/1998 Rothley
5,941,055 A * 8/1999 Coates ..... B65B 29/06 425/112
(Continued)

FOREIGN PATENT DOCUMENTS

DE 10 2011 081 010 10/2014
WO WO 2016/133768 8/2016

OTHER PUBLICATIONS

Nestlé, "Nestlé launches BabyNes, the first comprehensive nutrition system for babies, in Switzerland", http://www.nestle.com/media/newsandfeatures/nestle-launches-babynes-first-comprehensi . . . , downloaded Mar. 14, 2017.
(Continued)

*Primary Examiner* — Abbas Rashid
(74) *Attorney, Agent, or Firm* — Fish & Richardson P.C.

(57) ABSTRACT

The present disclosure provides systems and methods for locally producing a solution using a concentrate. In a localized solution production unit, a solution is identified in association with the concentrate. A mixing profile is selected from among a plurality of mixing profiles based on the solution identified. A base fluid is dispensed into a mixing container docked in a container dock. The mixing container includes a mixing impeller rotatably coupled to the mixing container via an impeller shaft extending from a base of the mixing container. A controller actuates an actuator in the container dock to cause an impeller in the mixing container to rotate. The concentrate is dispensed into the mixing container and mixed with the base fluid via the impeller based on the selected mixing profile.

51 Claims, 37 Drawing Sheets

(51) Int. Cl.

| | |
|---|---|
| ***B01F 7/22*** | (2006.01) |
| ***B01F 15/00*** | (2006.01) |
| ***B01F 13/10*** | (2006.01) |
| ***B01F 15/06*** | (2006.01) |

(52) U.S. Cl.

CPC ..... *B01F 15/00318* (2013.01); *B01F 15/065* (2013.01); *B01F 2003/0896* (2013.01); *B01F 2015/062* (2013.01); *B01F 2215/0031* (2013.01); *B01F 2215/0077* (2013.01)

(56) References Cited

U.S. PATENT DOCUMENTS 5,960,701 A * 10/1999 Reese ..... B67D 1/0039 222/135
7,077,290 B2 7/2006 Bethuy et al.
7,231,142 B1 * 6/2007 Leung ..... A47J 31/057 392/441
8,091,735 B2 1/2012 Girard et al.
8,210,396 B2 7/2012 Girard et al.
8,480,967 B2 7/2013 Zlatic et al.
8,960,999 B1 * 2/2015 Ochoa ..... A47J 43/044 366/207
9,022,642 B2 5/2015 Broome
2003/0116177 A1 6/2003 Appel et al.
2005/0061156 A1 * 3/2005 Hart ..... A47J 31/007 99/275
2005/0217213 A1 * 10/2005 Lozinski ..... B65B 29/02 53/453
2006/0000778 A1 1/2006 Martin et al.
2010/0133222 A1 * 6/2010 Mathieu ..... A47J 31/40 215/11.3
2011/0036452 A1 * 2/2011 Schnyder ..... B67D 1/0005 141/83
2013/0319034 A1 12/2013 Kounlavong et al.
2014/0291426 A1 10/2014 Herbert
2014/0373722 A1 * 12/2014 Talon ..... A47J 31/0668 99/280
2015/0201791 A1 * 7/2015 Tinkler ..... B65D 85/8043 426/431
2015/0265107 A1 * 9/2015 Buckalter ..... A47K 5/1211 222/63

OTHER PUBLICATIONS

Notification of Transmittal of the International Search Report and the Written Opinion of the International Searching Authority, or the Declaration issued in International Application No. PCT/US2017/013182 dated Apr. 3, 2017, 12 pages.

* cited by examiner

PRODUCING SOLUTIONS FROM CONCENTRATES

CROSS REFERENCE TO RELATED APPLICATIONS

The present application claims priority to U.S. Provisional Patent Application No. 62/277,642, filed Jan. 12, 2016, entitled "PRODUCING SOLUTIONS FROM CONCENTRATES," which application is incorporated herein by reference in its entirety.

TECHNICAL FIELD

This disclosure relates to systems and methods of producing solutions from concentrates.

BACKGROUND

Household cleaning and personal care products are generally purchased as finished products in disposable packaging. Many of these finished products consist primarily of water—in some cases over 90 percent—and a relatively small percentage of active ingredients. As such, this means that a consumer pays a significant cost for water, including the cost of transporting the water from a factory to a marketplace. This is not to mention the environmental cost of the greenhouse gas emissions associated with transporting the water. Additionally, consumers are also paying for disposable packaging materials, such as bottles, caps and dispensing systems like trigger sprayers and pumps, which typically either end up in a landfill, or are recycled as a best case scenario. Although some finished products are now being packaged in flexible packaging, which generally has a lower cost and smaller environmental footprint compared to rigid packaging, such finished products still consist primarily of water.

On a related note, finished products that consist primarily of water are inherently bulky and, therefore, take up a great deal of space, whether on a shelf in a retail environment, or in storage within a residential or commercial building. The concentrates necessary to produce the same volume of finished products are far less bulky, thereby resulting in meaningful transportation, merchandising and storage efficiencies.

Moreover, the existing finished product solution market generally limits a consumer to particular product options that are mass-produced by a manufacturer and offers little or no options for personalization and customization. Consumer choice is further limited by what a retailer stocks. If a consumer has acquired a personal preference for a particular fragrance, concentration, or other product parameter or ingredient, those preferences may not be available for certain products or the preferred fragrance, ingredient or other parameter may vary widely depending on the finished product manufacturer.

SUMMARY

This disclosure describes systems and methods of locally producing a solution from a concentrate pod. As used herein, the term solution can encompass a variety of physical states, including liquids, gels, pastes and creams, as well as both homogenous and heterogeneous mixtures, such as emulsions, where one or more of the mixed substances are not fully dissolved.

Some embodiments of these systems and methods provide a localized solution production unit for producing a solution on demand from a concentrate pod. The production unit includes a mixing container including a mixing impeller rotatably coupled to the mixing container via an impeller shaft extending from a base of the mixing container. The mixing container includes an opening at a neck of the mixing container. The production unit includes a pod dock configured to removably receive the concentrate pod. The pod dock includes a dock outlet. The concentrate pod includes a sealable spout portion configured to be positioned in the dock outlet and extend therethrough. The sealable spout portion is configured to release a concentrate from the concentrate pod into the mixing container. The production unit includes a container dock coupled to the pod dock and configured to removably receive and engage the mixing container during a distribution of one or more of a base fluid flowing from a base fluid source and a concentrate released from the concentrate pod through the sealable spout portion of the concentrate pod. The container dock is configured to retain the mixing container during a mixture of the base fluid and the concentrate. The container dock includes an actuator and a rotatable coupling connected to the actuator. The rotatable coupling is configured to rotatably actuate the impeller shaft to rotate the mixing impeller of the mixing container. The production unit includes a controller communicably coupled to the actuator and the base fluid source. The controller is configured to select a mixing profile from among a plurality of mixing profiles based on a solution identification. The controller is configured to cause the actuator to rotate after the impeller is submerged by the distribution of the base fluid to generate a vortex in the mixing container prior to distribution of the concentrate and to mix the base fluid and the concentrate based on the selected mixing profile.

In some implementations, the pod dock includes one or more surfaces configured to move with respect to another surface of the pod dock to change a volume within the pod dock so as to squeeze a concentrate pod positioned in the pod dock and evacuate the concentrate from the concentrate pod.

In some implementations, the pod dock includes at least one roller configured to move in the pod dock to squeeze a concentrate pod positioned in the pod dock and evacuate the concentrate from the concentrate pod.

In some implementations, the production unit includes a plunger configured to slide in the pod dock to press the concentrate from the concentrate pod.

In some implementations, the production unit includes a user interface configured to receive an input providing the solution identification.

In some implementations, the controller is configured to vary a mixing speed based on the solution identification.

In some implementations, the production unit includes a height adjustable platform coupling the pod dock to the container dock for adjusting a distance between the pod dock and the container dock.

In some implementations, the controller is configured to adjust the height adjustable platform based on the height of the mixing container positioned in the container dock.

In some implementations, the pod dock is configured to move the sealable spout portion of the concentrate pod into the opening at the neck of the mixing container for a direct transfer of the concentrate from the concentrate pod into the mixing container.

In some implementations, the controller is configured to control at least one of a fluid temperature of the base fluid, fluid quantity of the base fluid, and mixing duration, based on the solution identification. The mixing duration can include a minimum mixing time.

In some implementations, the production unit includes a heating element configured to heat the base fluid.

In some implementations, the production unit includes a scanner in the pod dock configured to scan a code on the concentrate pod.

In some implementations, the concentrate pod includes an electronic tag providing the solution identification.

In some implementations, the production unit includes an electronic tag detection unit in the pod dock configured to detect an electronic tag on the concentrate pod.

In some implementations, the fluid source includes a fluid reservoir coupled to the pod dock.

In some implementations, the production unit includes a pump coupled to the fluid reservoir.

In some implementations, the production unit includes one or more additive chambers configured to dispense an additive positioned in the additive chamber into the mixing container.

In some implementations, the controller is configured to cause the additive chamber to release at least one additive selected from a plurality of additives positioned in the one or more additive chambers into the mixing container.

Various embodiments provide a method of locally producing a solution on demand using a concentrate pod. The method includes identifying a solution associated with a concentrate contained in a concentrate pod positioned in a pod dock of a localized solution production unit. The method includes selecting a mixing profile from among a plurality of mixing profiles based on the solution identified. The method includes distributing a base fluid from a base fluid source into a mixing container docked in a container dock coupled to the pod dock through an opening at a neck of the mixing container. The mixing container includes a mixing impeller rotatably coupled to the mixing container via an impeller shaft extending from a base of the mixing container. The method can include causing, via a controller, an actuator in the container dock to rotate after the impeller is submerged by the base fluid to cause the mixing impeller to rotate. The method can include distributing a concentrate from the concentrate pod into the mixing container after the impeller is rotating. The method includes mixing the base fluid and the concentrate via the impeller based on the selected mixing profile.

In some implementations, the method includes identifying the solution based on detecting an identification of a tag positioned on the mixing container via at least one detector, where the detector is communicably coupled to the controller.

In some implementations, the method includes identifying the solution based on receipt of a user input at a user interface communicably coupled to the controller.

In some implementations, the method includes identifying the solution based on reading a code on the concentrate pod.

In some implementations, one or more of a mixing speed, a fluid temperature of the base fluid, a fluid quantity of the base fluid, and a mixing duration are determined based on the solution identification.

In some implementations, the method includes dispensing at least one additive substance into the mixing container.

In some implementations, the method includes identifying the solution based on an identification of the concentrate pod positioned in the pod dock via at least one detector, wherein the detector is communicably coupled to the controller.

In some implementations, identifying the solution comprises receiving a user selection from an application operating on a mobile electronic device communicably coupled to the controller. The user selection is selected via a user interface generated on the mobile electronic device via the application. The user selection is selected from among a plurality of options identified by the application.

In some implementations, the plurality of options is identified based on an identity of the pod positioned in the pod dock.

In some implementations, the method includes receiving an additive selection at the controller. The additive selection is selected from a plurality of additive options from the application via the user interface generated on the mobile electronic device.

In some implementations, the method includes selecting one or more additives for adding to the mixing container via the user interface generated on the mobile electronic device. The selected one or more additives is transmitted to the controller for dispensing into the mixing container.

Some embodiments provide a localized solution production unit for producing a solution on demand from a concentrate pod. The production unit includes a mixing container including a mixing impeller rotatably coupled to the mixing container via an impeller shaft extending from a base of the mixing container. The mixing container includes an opening at a neck of the mixing container. The production unit includes a pod dock configured to removably receive the concentrate pod, the pod dock including a dock outlet. The concentrate pod includes a sealable spout portion configured to be positioned in the dock outlet and extend therethrough. The sealable spout portion is configured to release a concentrate from the concentrate pod into the mixing container. The production unit includes a container dock coupled to the pod dock and configured to removably receive and engage the mixing container during a distribution of one or more of a base fluid flowing from a base fluid source and a concentrate released from the concentrate pod through the sealable spout portion of the concentrate pod. The container dock is configured to retain the mixing container during a mixture of the base fluid and the concentrate. The container dock includes an actuator and a rotatable coupling connected to the actuator. The rotatable coupling is configured to rotatably actuate the impeller shaft to rotate the mixing impeller. The production unit includes a controller communicably coupled to the actuator and the base fluid source. The controller is configured to select a mixing profile from among a plurality of mixing profiles based on a solution identification. The controller is configured to cause the actuator to rotate the impeller to generate a vortex for mixing the base fluid and the concentrate based on the selected mixing profile.

In some implementations at least one of the pod dock and the container dock are configured to move with respect to one another so as to position the sealable spout portion into the opening at a neck of the mixing container.

Some embodiments provide a localized solution production unit for producing a solution. The production unit includes a mixing container including a mixing impeller rotatably coupled to the mixing container via an impeller shaft extending from a base of the mixing container. The mixing container includes an opening at a neck of the mixing container. The production unit includes a concentrate container. The production unit includes a concentrate spout coupled to the concentrate container. The concentrate spout is configured to release a concentrate from the concentrate container into the mixing container. The production unit includes a container dock coupled to the concentrate container and configured to removably receive and engage the mixing container during a distribution of one or more of a base fluid flowing from a base fluid source and a concentrate released from a concentrate container. The container dock is configured to retain the mixing container during a mixture of the base fluid and the concentrate. The container dock includes an actuator and a rotatable coupling connected to the actuator. The rotatable coupling is configured to rotatably actuate the impeller shaft to rotate the mixing impeller. The production unit includes a controller communicably coupled to the actuator and the base fluid source. The controller is configured to select a mixing profile from among a plurality of mixing profiles based on a solution identification. The controller is configured to cause the actuator to rotate the impeller to generate a vortex for mixing the base fluid and the concentrate based on the selected mixing profile.

Various embodiments provide a computer program product for use on a localized solution production unit. The computer program product includes a computer usable medium having computer readable program code stored on the computer usable medium. The computer readable program code includes program code for selecting a mixing profile from a plurality of mixing profiles base on a solution identification. The computer readable program code includes program code for causing the localized solution production unit to distribute the base fluid and the concentrate into a mixing container based on the selected mixing profile. The computer readable program code includes program code for causing the localized solution production unit to mix the base fluid and the concentrate based on the selected mixing profile.

The details of one or more embodiments of these systems and methods are set forth in the accompanying drawings and the description below. Other features, objects, and advantages of these systems and methods will be apparent from the description and drawings, and from the claims.

Figure 1A:
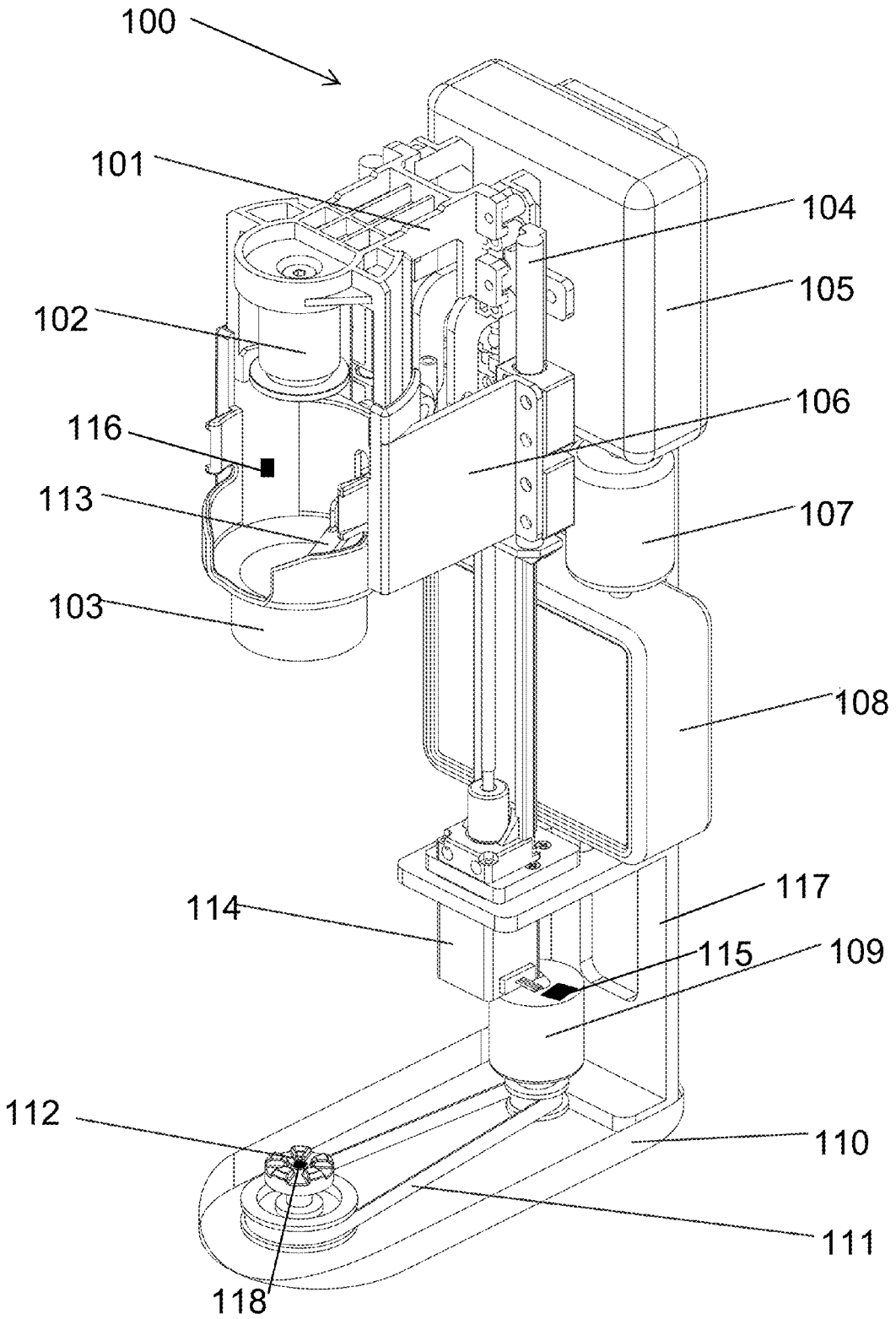
FIG. 1A is a perspective view of a localized solution production unit for producing a solution from a concentrate pod.

The drawings are primarily for illustrative purposes and are not intended to limit the scope of the systems and methods described in this disclosure. The drawings are not necessarily to scale. In some instances, various aspects of the systems and methods described in this disclosure may be exaggerated or enlarged in the drawings to facilitate an understanding of different features. In the drawings, like reference characters generally refer to like features (e.g., functionally similar and/or structurally similar elements).

The features and advantages of the systems and methods disclosed herein will become more apparent from the detailed description set forth below when taken in conjunction with the drawings.

DETAILED DESCRIPTION

Following below are more detailed descriptions of various concepts related to, and exemplary embodiments of, inventive systems, methods, and components of localized production units for producing a solution from a concentrate pod. In some implementations, localized solution production units identify a solution associated with a concentrate contained in a concentrate pod and mix the concentrate with a base fluid (e.g., water) using a mixing profile selected based on an identified solution. These systems and methods can be used to produce household cleaning products including, but not limited to, dish soaps, all-purpose cleaners, bathroom cleaners, glass cleaners, wood cleaners, air fresheners, car wash solutions, laundry detergents, and fabric softeners. These systems and methods can also be used to produce personal care products including, but not limited to hand soaps, shampoos, hair conditioners, body washes, face washes, bubble baths, body lotions, cosmetics, creams, and serums.

FIG. 1A is a perspective view of a localized solution production unit for producing a solution from a concentrate pod.

The localized solution production unit 100 is implemented to mix a finished product (e.g., a household cleaning product, a personal care product, a cosmetic product or another solution) intended to be used outside of the unit from a concentrate contained in a concentrate pod. The localized solution production unit 100 includes a pod dock configured to house the concentrate pod. The localized solution production unit 100 includes a liquid holding vessel or a reservoir 105 and a pump 107 configured to pump a base fluid from the reservoir 105. The base fluid pumped from the reservoir 105 is pumped through the water spout 113 into the mixing container. In certain embodiments, the water spout 113 is a movable water spout configured to move from a filling position for filling the mixing container to a retracted position, for example being retracted during dispensing of the concentrate from a concentrate pod into a mixing container (e.g., mixing container 203 shown in FIG. 2A). The pod dock 103 of localized solution production unit 100 is configurable to receive a concentrate pod and to reposition the concentrate pod as discussed in further detail herein. The pod dock 103 includes a pod plunger 102 for evacuating the concentrate from the concentrate pod. The pod dock 103 includes a plunger slide 101 for actuating the plunger 102. The pod dock 103 is coupled to a container dock 110 and is positioned on a slide shaft 104 to adjust a height of the pod dock 103 with respect to the container dock 110. A frame 117 couples the container dock 110 to the pod slide shaft 104 and the pod dock 103. A slide drive motor 114 drives the pod dock 103 on the slide shaft 104 via the pod slide 106. The pod dock 103 includes a docking outlet shroud configured to properly position the pod dock 103 on a mixing container as the height of the pod dock 103 is adjusted. In certain embodiments, the production unit 100 is configured to detect a height of a mixing container and adjust the height of the pod dock 103 based thereon.

In certain embodiments, the production unit 100 is configured to detect a height and/or a volume of a mixing container via a code, a tag, or other indicia (e.g., tag 1010 shown in FIG. 10D) positioned on a portion of the mixing container such as a base of the mixing container and detected, scanned, or read by a detection unit 118 in the container dock 110. The tag (i.e., tag 1010) can provide other information, such as an identification of the solution to be mixed therein, or other unique identification information that may be read therefrom to guide mixing. Once the height of the mixing container is determined from the detection unit 118, one or more controller 115 can actuate the slide drive motor 114 to adjust the height of the pod dock 103 with respect to the container dock 110. In certain embodiments, the production unit 100 includes one or more optical sensors for sensing a height of the mixing container. The production unit 100 can include one or more sensors, such as capacitive touch sensors or pressure sensors positioned about the pod dock outlet to properly position the pod dock 103 on a mixing container as the height of the pod dock 103 is adjusted. Such sensors may ensure proper positioning of the pod dock 103 relative to the mixing container without detecting a specific height of the mixing container. The production unit 100 adjusts the height of the pod dock 103 so as to position a spout portion of a concentrate pod directly into an opening in a neck of the mixing container. Such positioning allows the concentrate pod to be emptied directly into a mixing container without the contents contained in the concentrate pod contacting the pod dock or other portions of the machine. This contactless deployment of the concentrate, reduces or eliminates clean up and prevents cross contamination of concentrate contents when different concentrate pods are used sequentially.

In certain embodiments, the pod dock can also include one or more detectors, scanners, or readers 116 in the pod dock 103 for detecting an electronic tag or reading a code on a concentrate pod. The code can indicate, for example, one or more solutions that can be produced with the concentrate pod. The detector can include a bar code scanner. However, some systems include other identification devices such as, for example, a QR code scanner, an RFID tag detection unit, or another device configured to determine at least one solution identification based on an identifier contained on the concentrate pod.

The container dock 110 includes an actuator, impeller drive motor 109, coupled to impeller drive 112 via impeller drive belt 111. In certain embodiments, the impeller drive motor 109 can be connected to impeller drive 112 via a shaft or other rotatable coupling (which can include magnetic field couplings) and can directly drive the impeller drive 112. The drive motor 109 of the container dock 110 is controlled by the one or more controllers 115 of the production unit. The controller 115 includes one or more processors coupled to the drive motor 109 and the pump 107. The controller 115 is configured to select a mixing profile from among a plurality of mixing profiles stored in a memory device. The controller 115 selects the mixing profile based on a solution identification. The solution can be identified by a user via a user interface, such as a graphical user interface of the production unit 100. The localized solution production unit 100 includes a machine housing (such as outer shell 1900*a* and 1900*b* shown in FIGS. 19A and 19B) for housing various components. The machine housing can include the user interface providing a control panel. The control panel can be in the form of an LED display screen (such as an LED display screen), which may include a display portion, such as a tactile sensitive display portion. The control panel may have one or more controls, such as buttons, dials, or knobs, in addition to the LED display screen to receive or communicate information from/to the user about applicable products to be mixed, a mixing cycle in process, a remaining mixing time and other applicable information about the concentrate pod, the selected mixing profile, or the final solution.

The solution can also be identified via the detection device 116 or a reader in the pod dock 103 reading a tag or code (e.g. tag 410, 910) on the concentrate pod communicably coupled to the controller. The solution can be identified by a remote user through a user interface generated on an electronic device (such as a mobile phone, tablet, P.C., or other remote computing device wireless connectable to unit 100) running a computer application. The user interface on the remote electronic device generates commands for sending to the controller 115 via a communication component and wireless protocol of the remote electronic device wirelessly and communicably coupled to the controller 115.

The selected mixing profile includes mixing instructions to produce a particular solution identified by the concentrate pod or user selection. The mixing profile includes, for example, one or more of a dilution percentage and active mixing or agitation characteristics, such as a minimum mixing duration, mixing speed, or frequency for agitation (e.g., RPM). For example, the mixing profile can identify a water temperature of between 80-100 Degrees F., a water volume of 472 ml, and a mixing speed of between 800-1000 RPM, for a mixing period of 90-120 seconds to produce a particular solution. The mixing instructions can include, for example, an identification of one or more base fluids, an amount of the base fluid(s) to be dispensed from the reservoir 105, whether or not such fluid(s) will be heated, cooled, or at room temperature, a flow rate of such fluid(s), a mixing cycle/speed or frequency of a mixing shaft or a mixing duration. Fluid properties such as fluid temperature and fluid flow rate may be controlled, at least in part, by one or more of a temperature or flow rate regulator upstream of the water spout 113. The fluid flow rate may also be controlled by a physical characteristic of a fluid pathway through the concentrate pod, which can include a cross sectional area of the fluid pathway. The mixing profile, may also indicate a particular time period, during which to dispense the concentrate into the agitated base and or a particular flow rate of introducing the concentrate.

The controller 115 is configured to cause the drive motor 109 to rotate to drive an impeller of a mixing container according to the selected mixing profile. As discussed herein, in certain embodiments, the controller 115 can be configured to actuate the drive motor to rotate the impeller of the mixer container after the impeller is submerged by the distribution of the base fluid. Submerging of the impeller can be determined by one or more sensors (such as one or more optical sensors configured to determine a height of the impeller and/or the level of fluid in the mixing container) or based on a calculation or determination of an amount of fluid required to substantially submerge the impeller of a particular mixing container. For example, after a certain percentage (or range such as 25-50%) of the total base fluid being dispensed has been dispensed into the mixing container. The mixing container can be identified through detection (e.g., via indicia or an electronic tag on the mixing container or on the base of the mixing container) or manually, for example via the user interface by the user.

In certain embodiments, submerging of the impeller can be determined by a circuit being closed between electrical contacts positioned on the impeller and electrical contacts in a base of the mixing container through the base fluid acting as a conductor between the contacts, whereby a signal is generated and transmitted to the controller 115. A low voltage battery cell may be positioned in the base of the mixing container to transmit the signal from one contact in the base to a contact on the impeller (as shown for example in FIG. 10E). The closed circuit between the contacts via the base fluid can cause a low cost passive wireless transmitter connected to one of the contacts to become activated and submit a signal to the controller 115 for a limited duration or only when the mixing container is docked and thereby cause drive motor 109 to be activated. Actuating the impeller of the mixing container after submergence helps optimize mixing through the generation of a vortex in the mixing container prior to distribution of the concentrate. The mixing container base and body can be composed of insulators that will prevent conduction beyond the fluid in such embodiments.

In certain embodiments, submerging of the impeller by the base fluid can be determined by the base fluid causing some other detectable change in the impeller such as a detectable change in a color of the impeller, limiting or changing transmission of a signal transmitted through the impeller such as a light signal (in the visible or invisible spectrum), bent, blocked, or distorted by the base fluid upon the fluid reaching the impeller.

In certain embodiments, submerging of the impeller by the base fluid can cause a floating lock to be released when the fluid is above a certain level to permit actuation of the impeller.

In some embodiments, the controller 115 can be configured to actuate the drive motor 109 to rotate the impeller of the mixing container after a pre-specified volume of base fluid has been dispensed. The controller 115 continues to actuate the impeller of the mixing container to mix the base fluid and the concentrate for a minimum duration based on the selected mixing profile. The mixing profile identifies one or more of the mixing speed, a fluid temperature (for example controlled by a heating element in the reservoir 105 or in the water spout that is controlled by or controlled by the heater controller 108) of the base fluid, a fluid quantity of the base fluid, and a mixing duration. As discussed further herein, the controller 115 can also be used to control the dispensing of one or more additives to the solution. The controller 115 can control which additives are included and the controller 115 can control when any such additive is dispensed based on the mixing profile selected to produce the specified solution. The additives can control the appearance, consistency/viscosity, fragrance or other solution properties or functions to permit personalization of the solution.

The base fluid typically is or includes water. The reservoir 105 is a removable water reservoir including an opening for filling the reservoir in place or when removed. In certain embodiments, the reservoir 105 can be coupled directly to a water source via a water pipe supplying water directly to the reservoir 105. In such instances, the reservoir 105 can include a valve operable to open and close in order to receive additional water when the water level in the reservoir 105 is below a particular level. Some systems use base fluids other than water or in addition to water. These systems may include multiple reservoirs. In certain embodiments the water reservoir may include or be coupled to a water treatment system or include one or more water filters for removing contaminants from the base fluid.

Figures 1B, 1C, 1D, 1E, 1F, 1G:
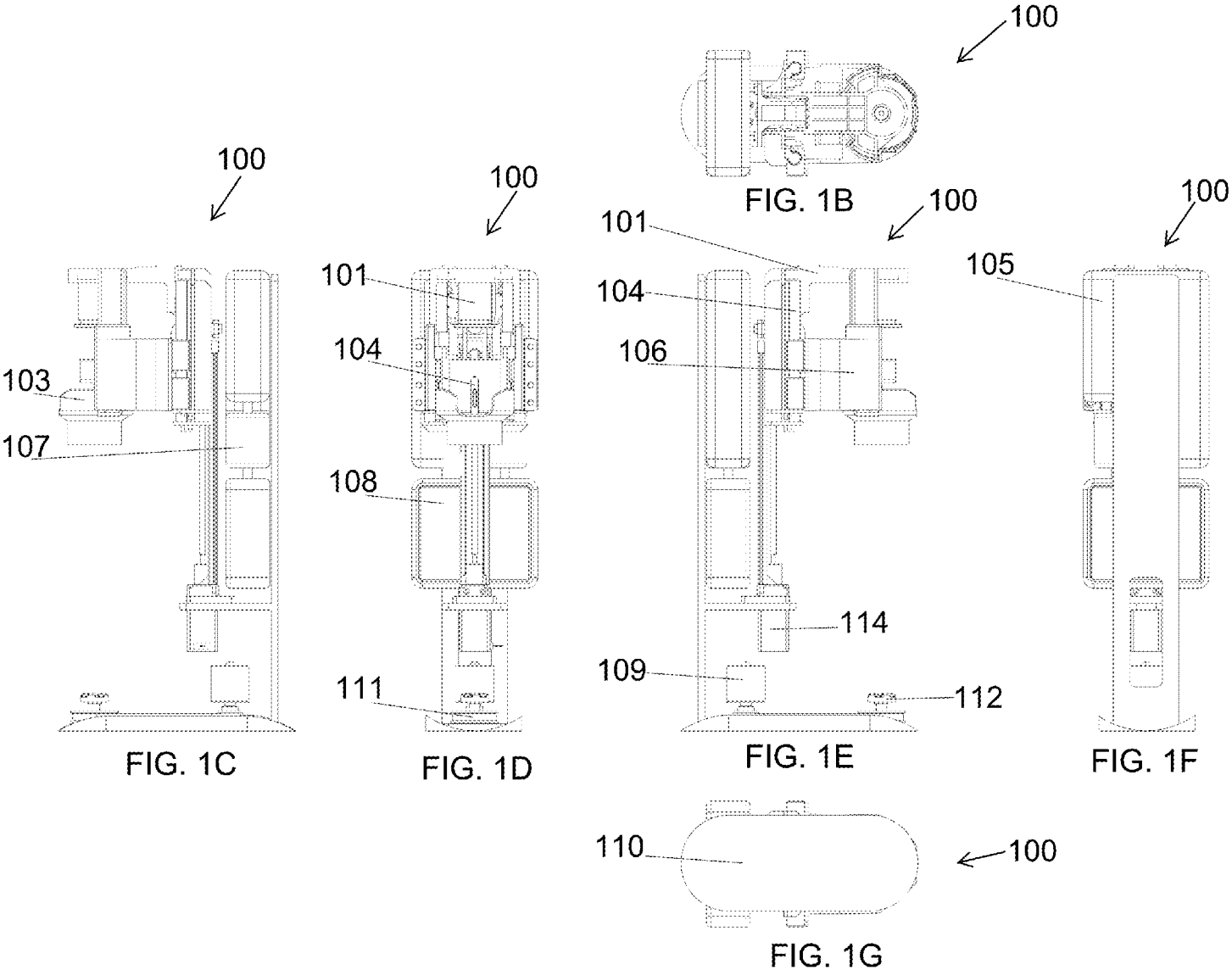
FIG. 1B is top view of the localized solution production unit of FIG. 1A.
FIG. 1C is first side view of the localized solution production unit of FIG. 1A.
FIG. 1D is front view of the localized solution production unit of FIG. 1A.
FIG. 1E is second side view of the localized solution production unit of FIG. 1A.
FIG. 1F is back view of the localized solution production unit of FIG. 1A.
FIG. 1G is bottom view of the localized solution production unit of FIG. 1A.

FIG. 1B is top view of the localized solution production unit of FIG. 1A.

FIG. 1C is first side view of the localized solution production unit of FIG. 1A.

FIG. 1D is front view of the localized solution production unit of FIG. 1A.

FIG. 1E is second side view of the localized solution production unit of FIG. 1A.

FIG. 1F is back view of the localized solution production unit of FIG. 1A.

FIG. 1G is bottom view of the localized solution production unit of FIG. 1A.

Figure 2A:
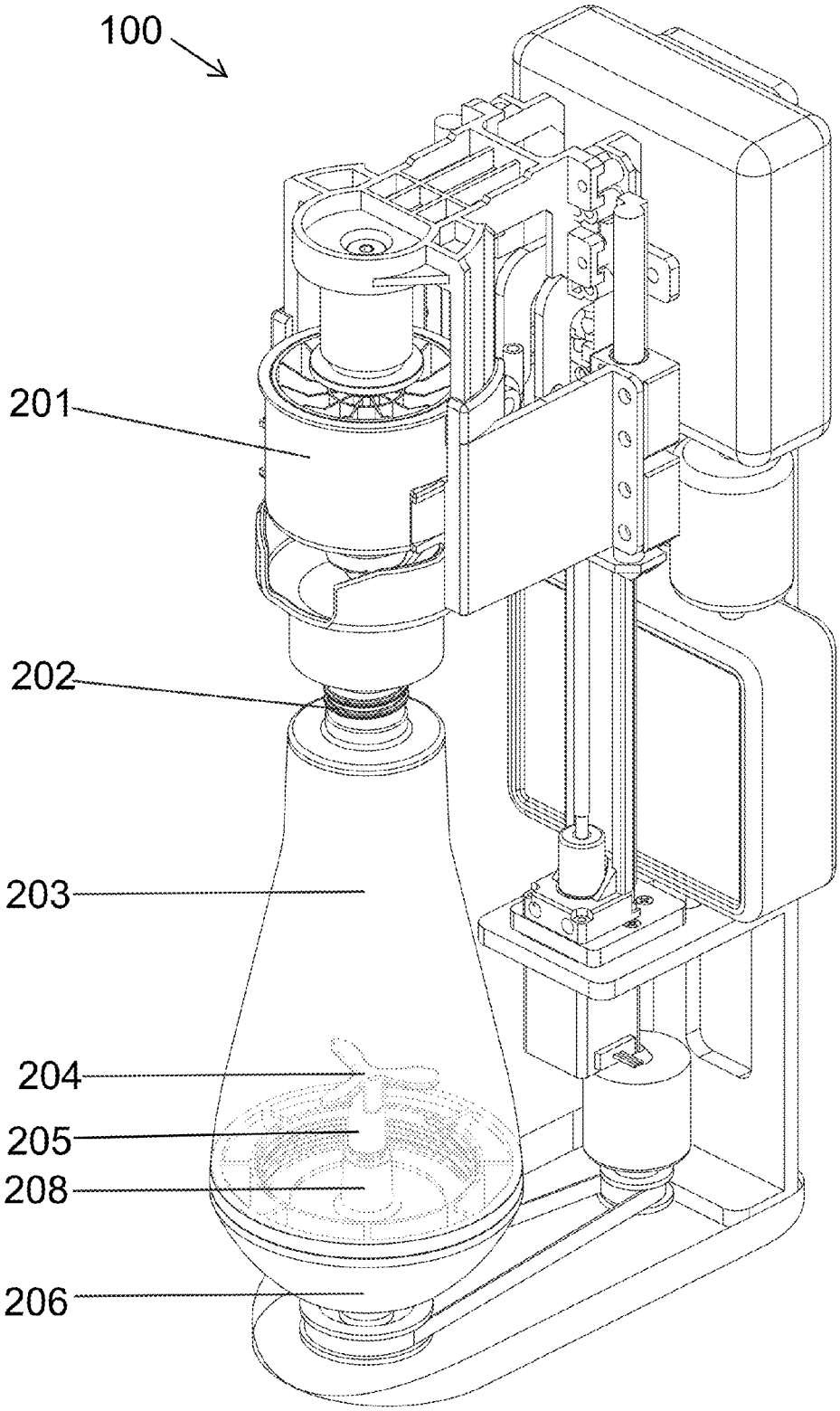
FIG. 2A is a perspective view of the localized solution production unit of FIG. 1A with a concentrate pod and a mixing container docked therein.

FIG. 2A is a perspective view of the localized solution production unit of FIG. 1A with a concentrate pod and a mixing container docked therein. As shown in FIG. 2A, the mixing container 203 is docked on the container dock 110 via the mixing container base 206. The mixing container base 206 includes a rotatable coupling (e.g. coupling 1007 shown in FIG. 10D) configured to matingly engage the impeller drive 112 (shown in FIG. 1A). The mixing container 203 includes an impeller shaft 205 rotatably coupled to the mixing base 206 and configured to rotate the mixing impeller 204. The impeller shaft 205 extends from impeller base 208, and the impeller shaft 205 is coupled to coupling 1007 (shown in FIG. 10D), which rotates in the mixing base 206 when actuated by the impeller drive 112 to rotate the impellers shaft 205 and the impeller 204. The mixing container 203 includes an opening 207 in the neck 202 of the mixing container 203. The production unit 100 includes a concentrate pod 201 positioned in the pod dock 103. As discussed in further detail herein, the concentrate pod 201 includes a spout portion that can be sealed and that extends through an opening in the pod dock 103 for insertion directly into the opening 207 in the neck 202 of the mixing container 203. As shown in FIG. 2A, the neck 202 can be threaded for removably receiving one or more dispensing closures or systems used to extract and dispense the solution from the mixing container 203. The concentrate pod 201 can include a rigid pod in certain embodiments and can include a flexible pod in certain embodiments. The flexible pod can be configured for squeezing, straining, or pressing while the rigid pod can be configured for plunging.

Figures 2B, 2C, 2D, 2E, 2F, 2G:
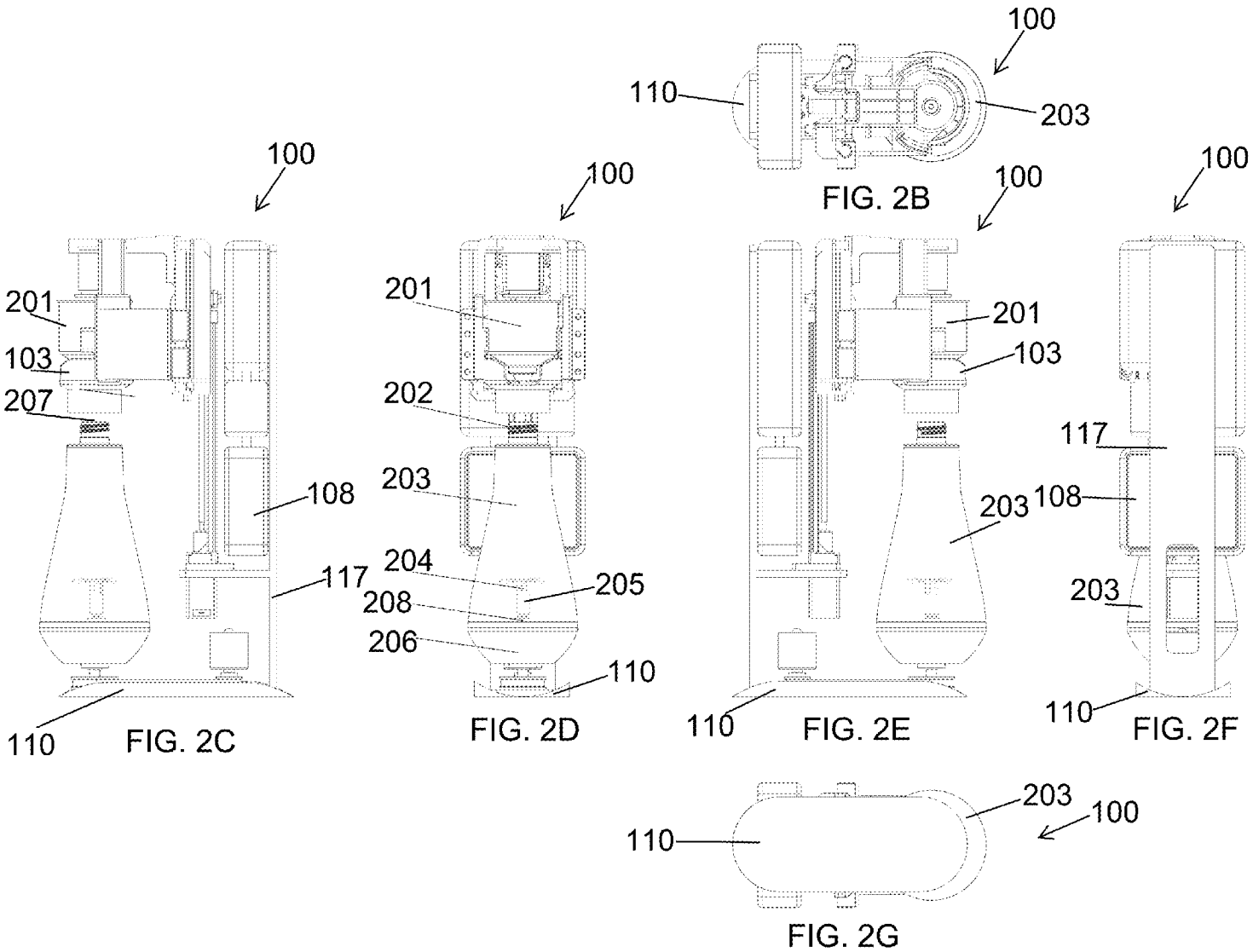
FIG. 2B is top view of the localized solution production unit of FIG. 2A.
FIG. 2C is first side view of the localized solution production unit of FIG. 2A.
FIG. 2D is front view of the localized solution production unit of FIG. 2A.
FIG. 2E is second side view of the localized solution production unit of FIG. 2A.
FIG. 2F is back view of the localized solution production unit of FIG. 2A.
FIG. 2G is bottom view of the localized solution production unit of FIG. 2A.

FIG. 2B is top view of the localized solution production unit of FIG. 2A.

FIG. 2C is first side view of the localized solution production unit of FIG. 2A.

FIG. 2D is front view of the localized solution production unit of FIG. 2A.

FIG. 2E is second side view of the localized solution production unit of FIG. 2A.

FIG. 2F is back view of the localized solution production unit of FIG. 2A.

FIG. 2G is bottom view of the localized solution production unit of FIG. 2A.

Figure 3A:
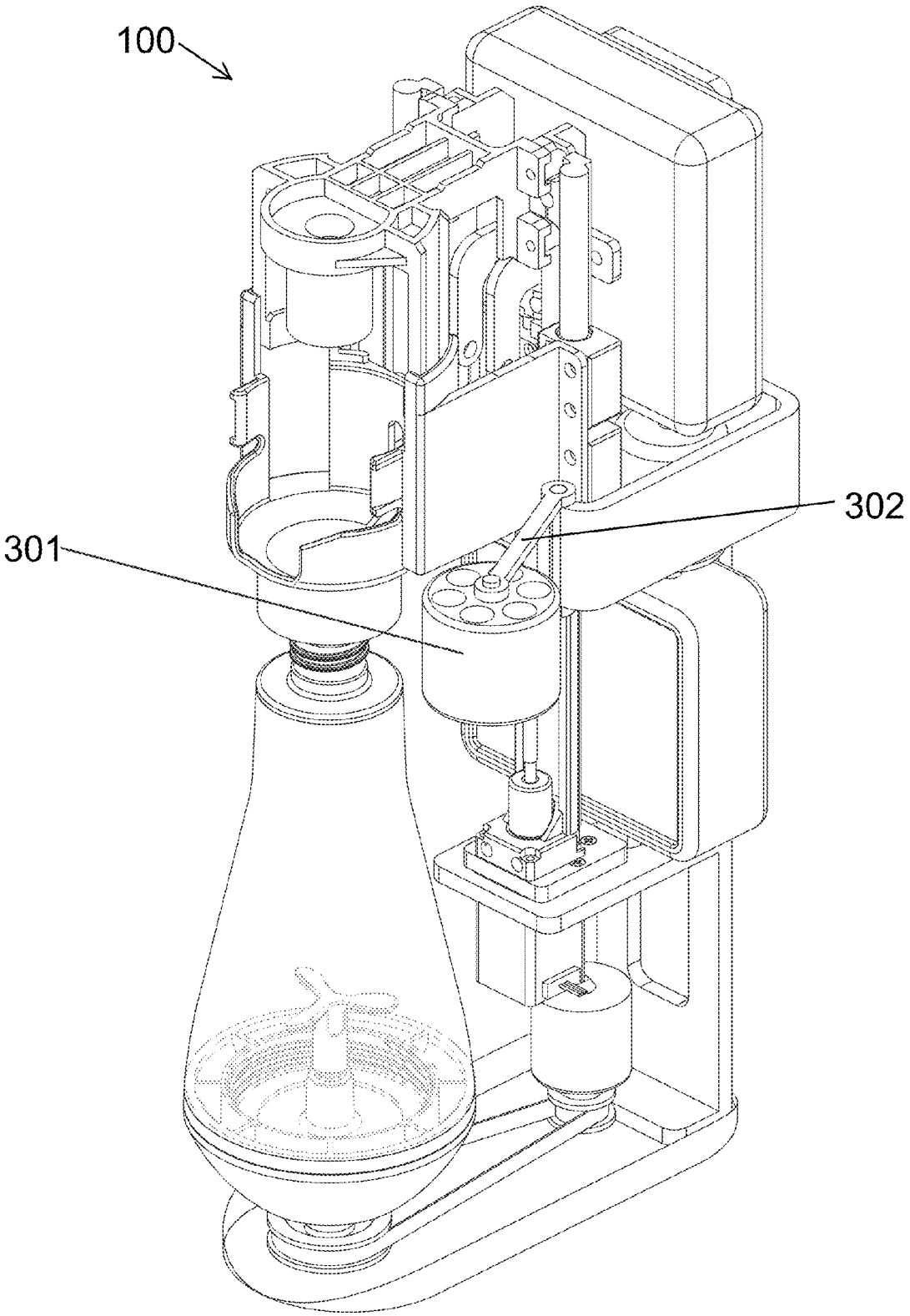
FIGS. 3A and 3B are perspective views of the localized solution production unit of FIG. 1A including an additive chamber and with the concentrate pod undocked therefrom with and a mixing container docked therein.
Figure 3B:
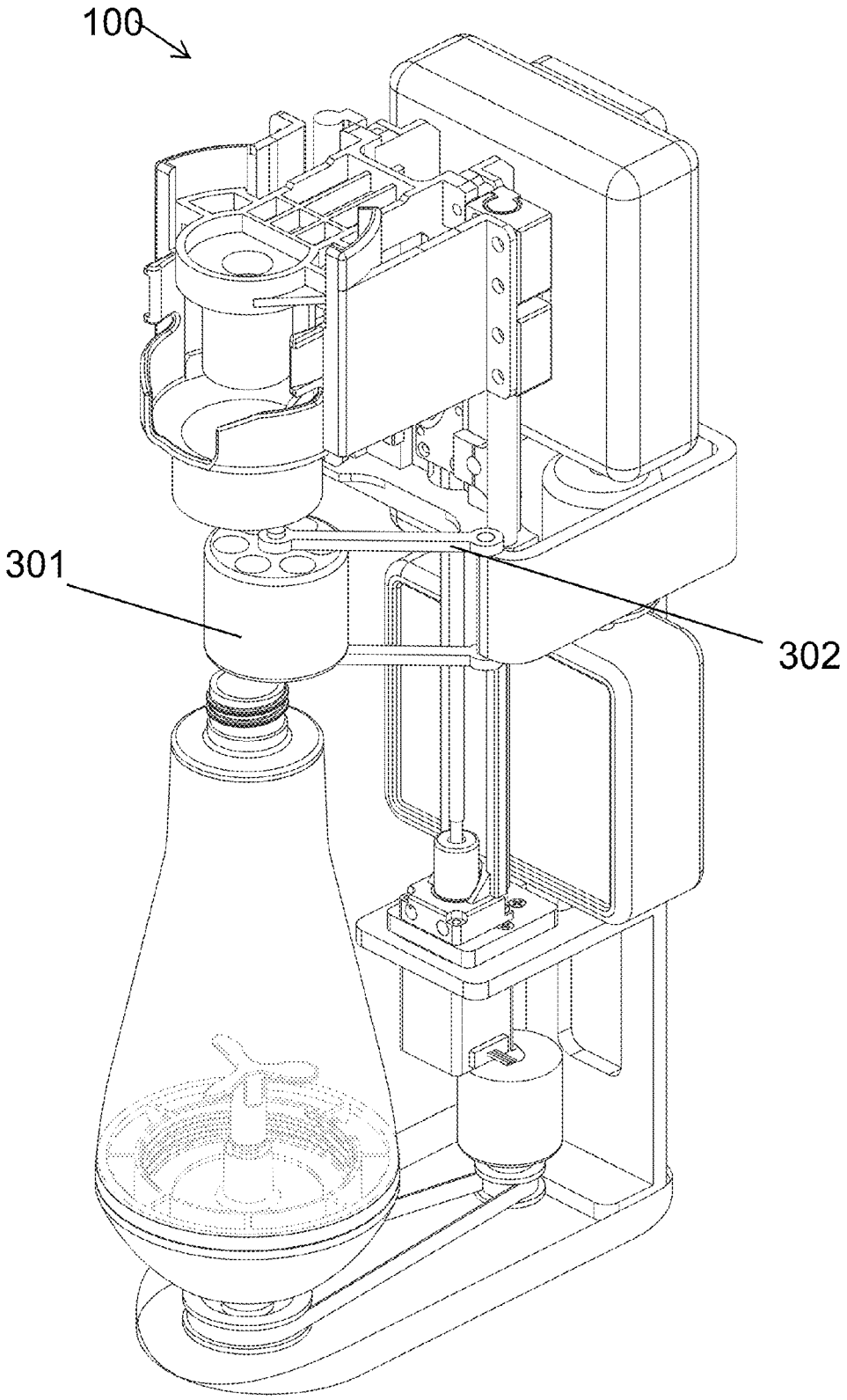

FIGS. 3A and 3B are perspective views of the localized solution production unit of FIG. 1A including an additive chamber and with the concentrate pod undocked therefrom with and a mixing container docked therein. The localized solution production unit 100 is illustrated in FIG. 3A with an additive chamber 301 that can be used to add one or more additives or auxiliary substances into the solution. The additives can include, but are not limited to, fragrances, colorants, emulsifiers, solubilizers, rheology modifiers to alter viscosity, opacifiers and pearlizing agents, botanical extracts and oils, vitamins, antibacterial agents and other functional or active ingredients, as well as mixtures/blends of one or more of such additives. The additive chamber 301 is shown repositioned in FIG. 3B for dispensing of the additive into the opening 207 of the mixing container 203. The additive chamber 301 can be configured to rotate or otherwise be positioned for dispensing of a particular additive from the additive chamber 301. The position can be determined by the controller 115 based on a user selection and based on a determination of one or more additives positioned in the additive chamber. In certain embodiments, the water spout 113 dispenses fluid through a conduit of the additive chamber to dispense the additive from the additive chamber. In certain embodiments, the additives may be packaged in a cartridge, or encapsulated in water soluble film. The additive chamber can include one or more sensors or detectors configured to read an electronic tag or indicia on the additive cartridge. The one or more sensors can be communicably coupled to the controller 115 so that the controller can cause an appropriate additive to be dispensed from the additive chamber based on a user selection.

Figure 4A:
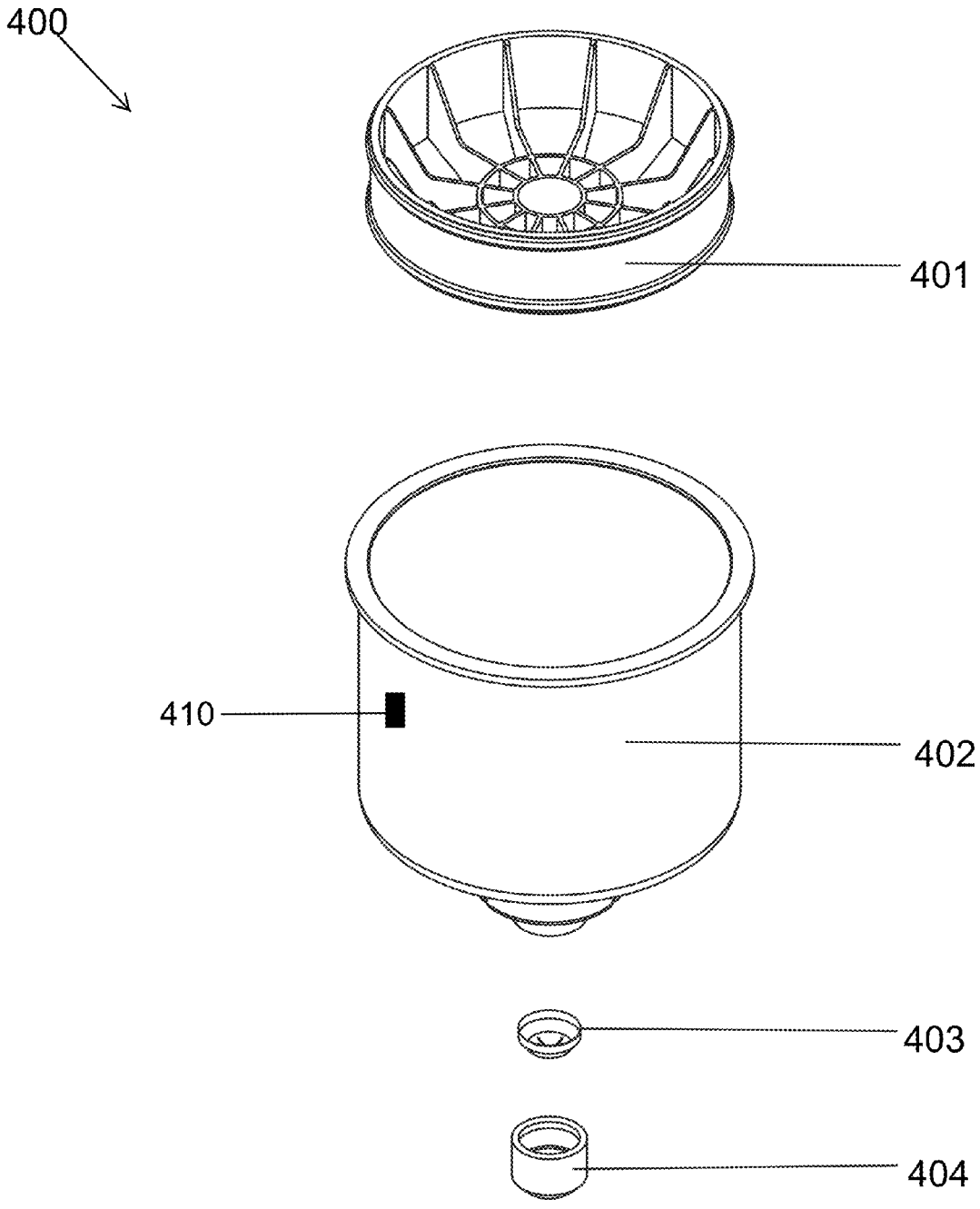
FIGS. 4A and 4B are exploded views of a concentrate pod with a snap valve seal, in accordance with various embodiments.
Figure 4B:
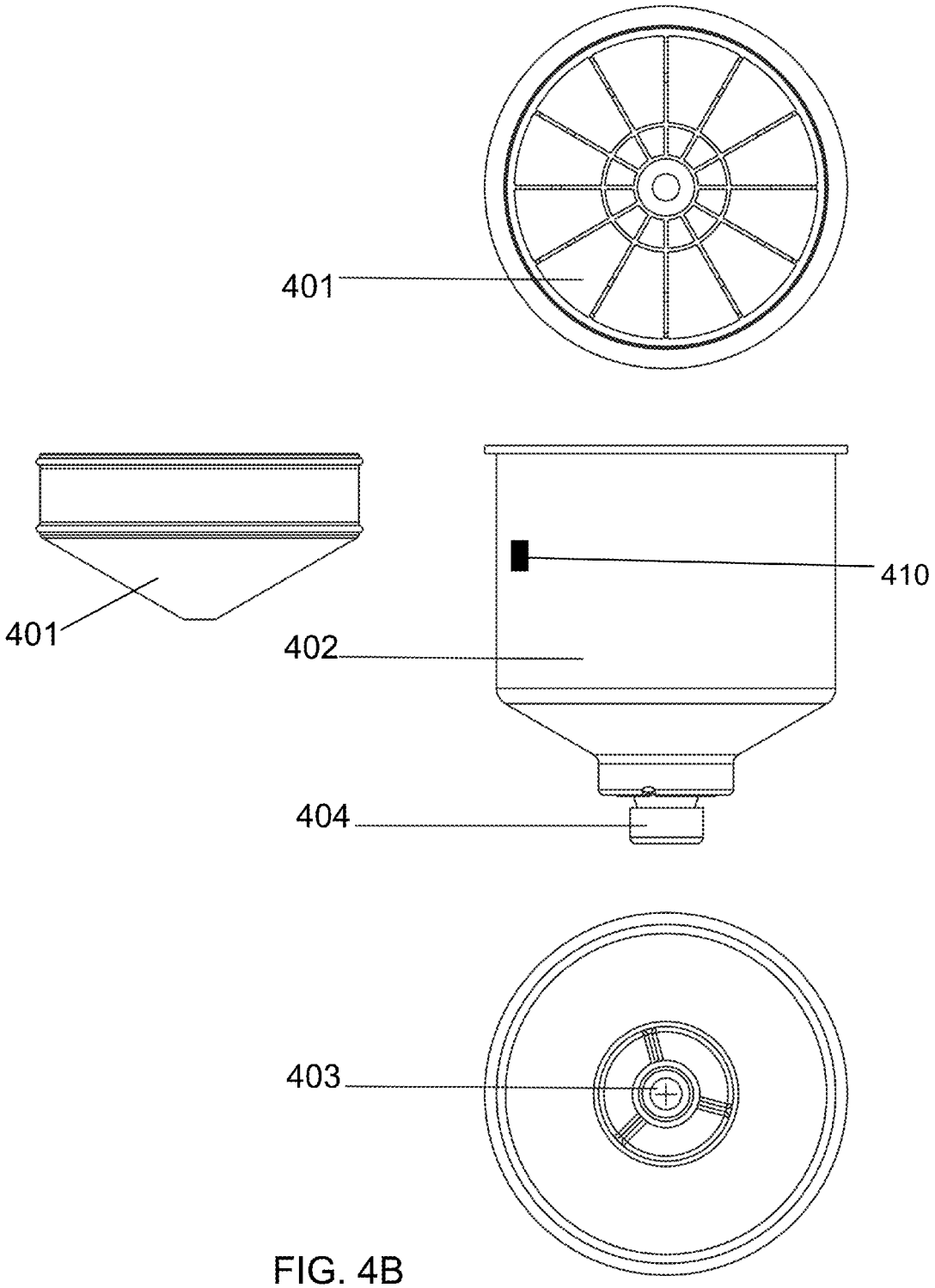

FIGS. 4A and 4B are exploded views of a concentrate pod with a snap valve seal in accordance with various embodiments. The concentrate pod 400 includes a rigid cartridge cylinder 402 configured to receive a slidable piston 401. The slidable piston 401 slides in the cylinder 402 to evacuate the concentrate contents from the pod 400. The concentrate pod 400 includes a valve 403, such as a silicon valve, for gating the flow of the concentrate from the pod 400. The valve 403 may be snapably coupled to the rigid pod cylinder with a collar 404 to hold the valve in place. In certain embodiments, the collar 404 is covered by an overcap, that can be snapably removed from the collar 404 by the user before insertion in the pod dock 103. The valve 403 can be a passive valve providing enough resistance to prevent the concentrate from flowing from the pod 400 when no force is present, but opening in response to an increase in pressure in the cylinder 402 when the piston 401 slides in the cylinder 402 in response to actuation by plunger 102. As shown in FIG. 4B, the piston 401 can be tapered with the same taper as cylinder 402 so that the piston 401 can evacuate substantially all of the concentrate from the pod 400. The concentrate pod 400 can include a tag 410, such as an RFID tag, a scanable code, or other indicia that can be detected, read, or identified by detection device 116 when the pod 400 is positioned in the pod dock 103.

Figure 5C:
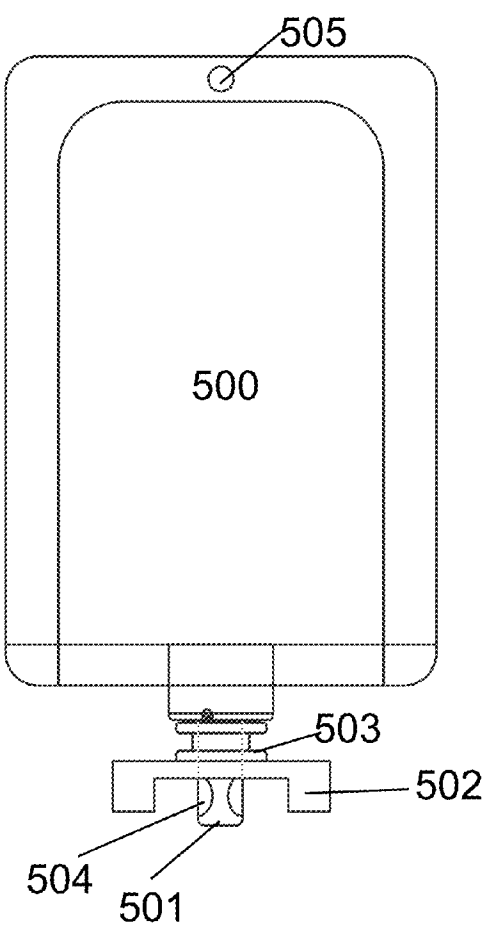
FIGS. 5A-5C are front views of a concentrate pod, in accordance with various embodiments.
Figure 5B:
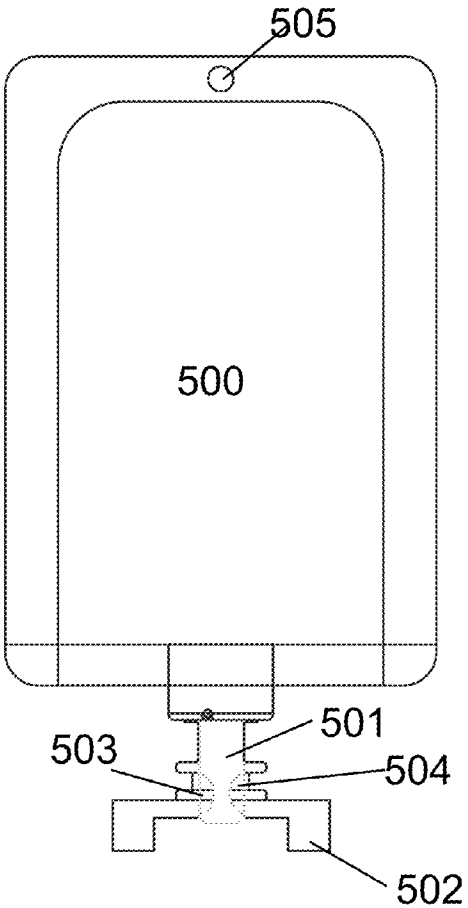
Figure 5A:
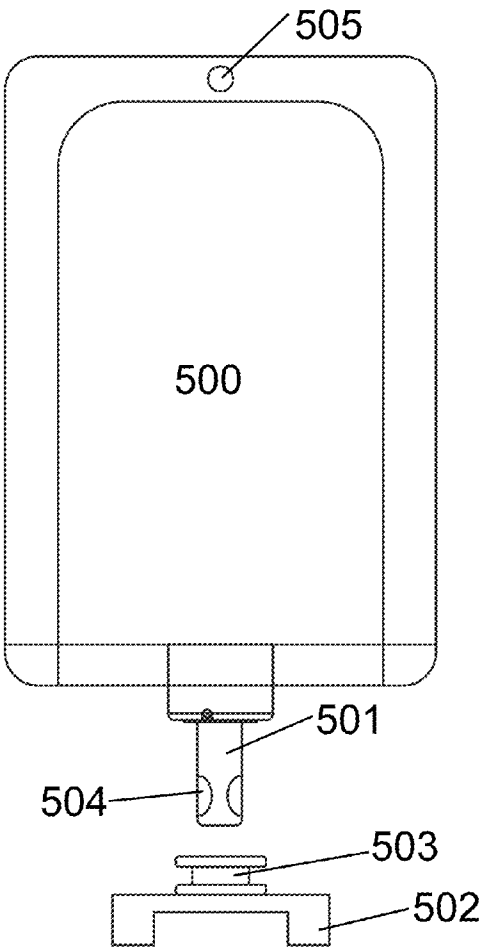

FIGS. 5A-5C are front views of a concentrate pod in accordance with various embodiments. A concentrate pod 500 can include a flexible pouch body having a spout 501 integrally connected thereto. The spout 501 includes apertures 504 providing an outlet for concentrate contained in the pod 500. The apertures 504 can be covered in one state via cover 503 of collar 502. FIG. 5B shows the collar 502 in a first position for sealing the apertures 504. FIG. 5C shows the collar 502 in a second position for unsealing the apertures 504. The collar 502 can be slidably actuated by a pod dock pressing the collar 502 onto the neck of the mixing container when the height of the pod dock is adjusted with respect to the container dock. The pod 500 includes a hanging aperture 505 for suspension of the pod 500 in a pod dock.

Figure 6A:
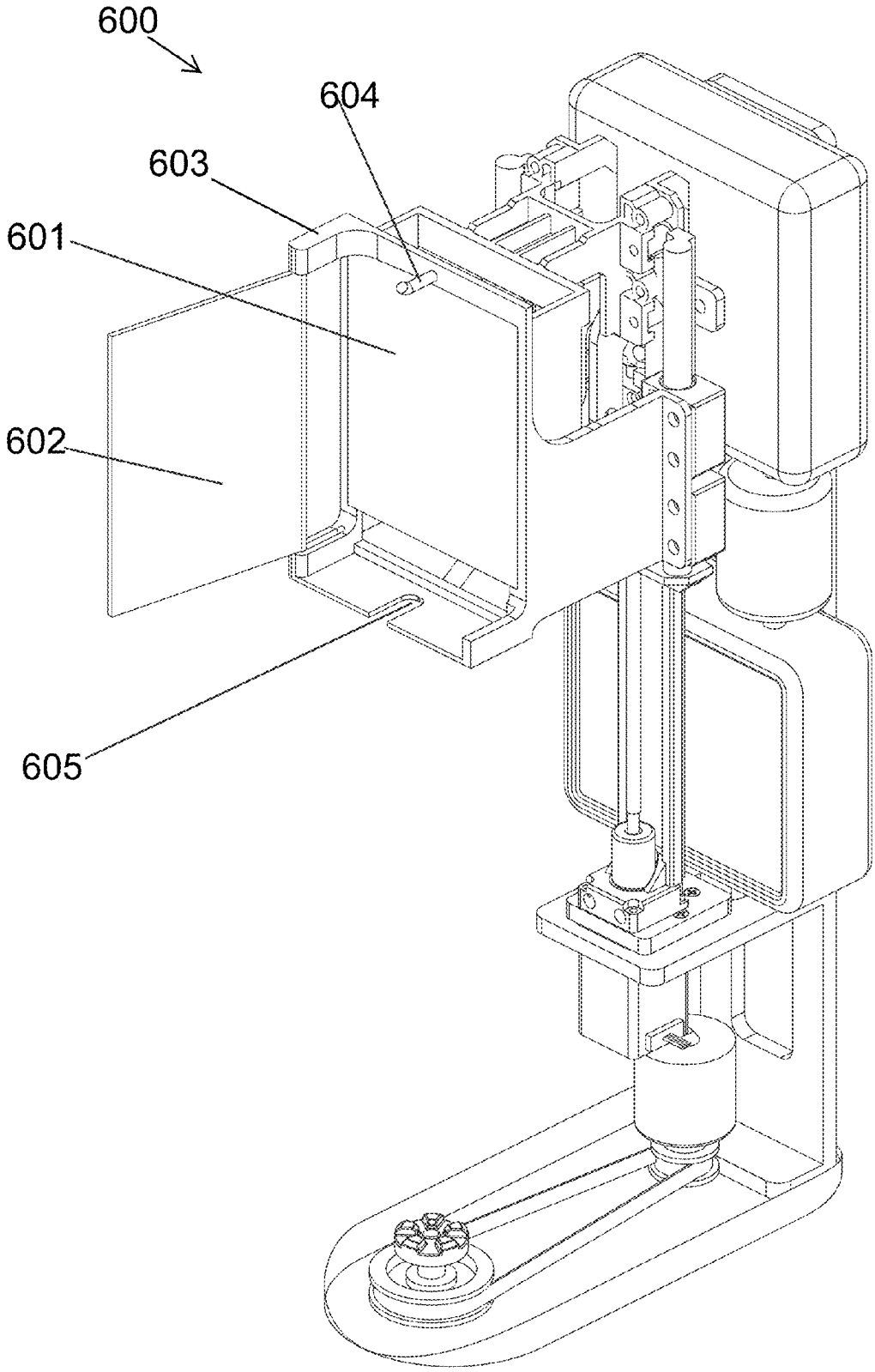
FIGS. 6A-6D are perspective views of a localized solution production unit for producing a solution from a concentrate pod including a pressing pod dock.
Figure 6B:
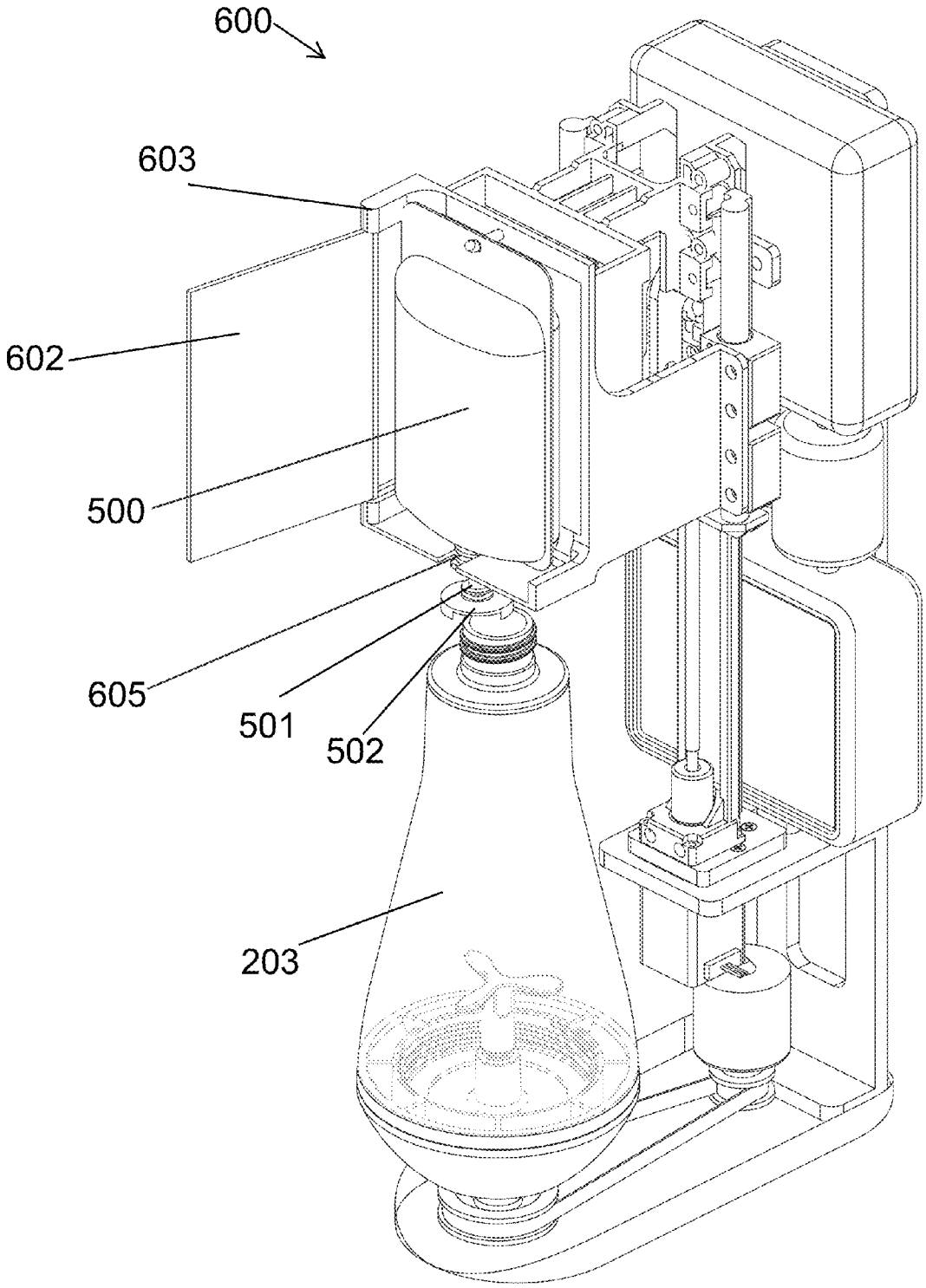
Figure 6C:
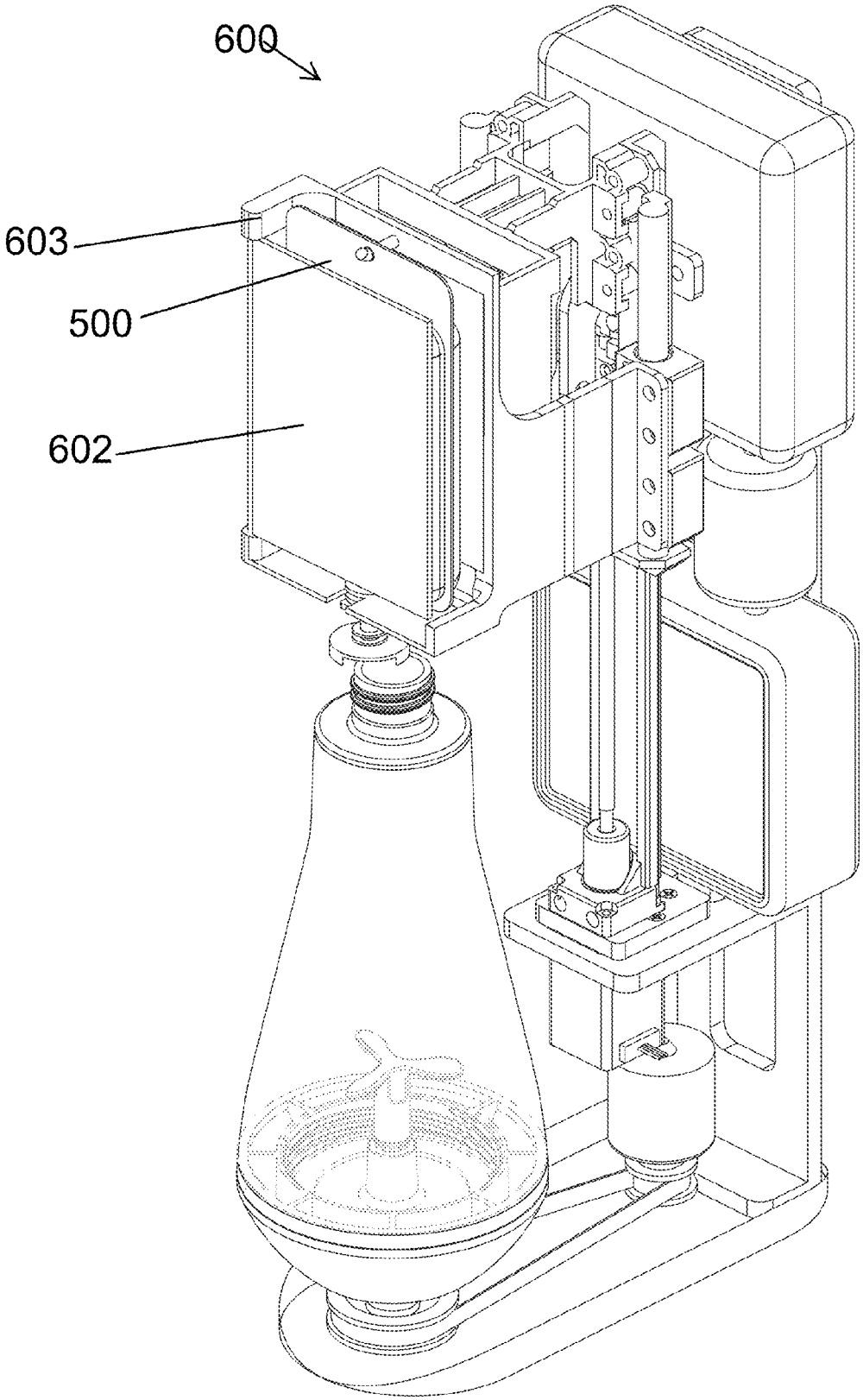
Figure 6D:
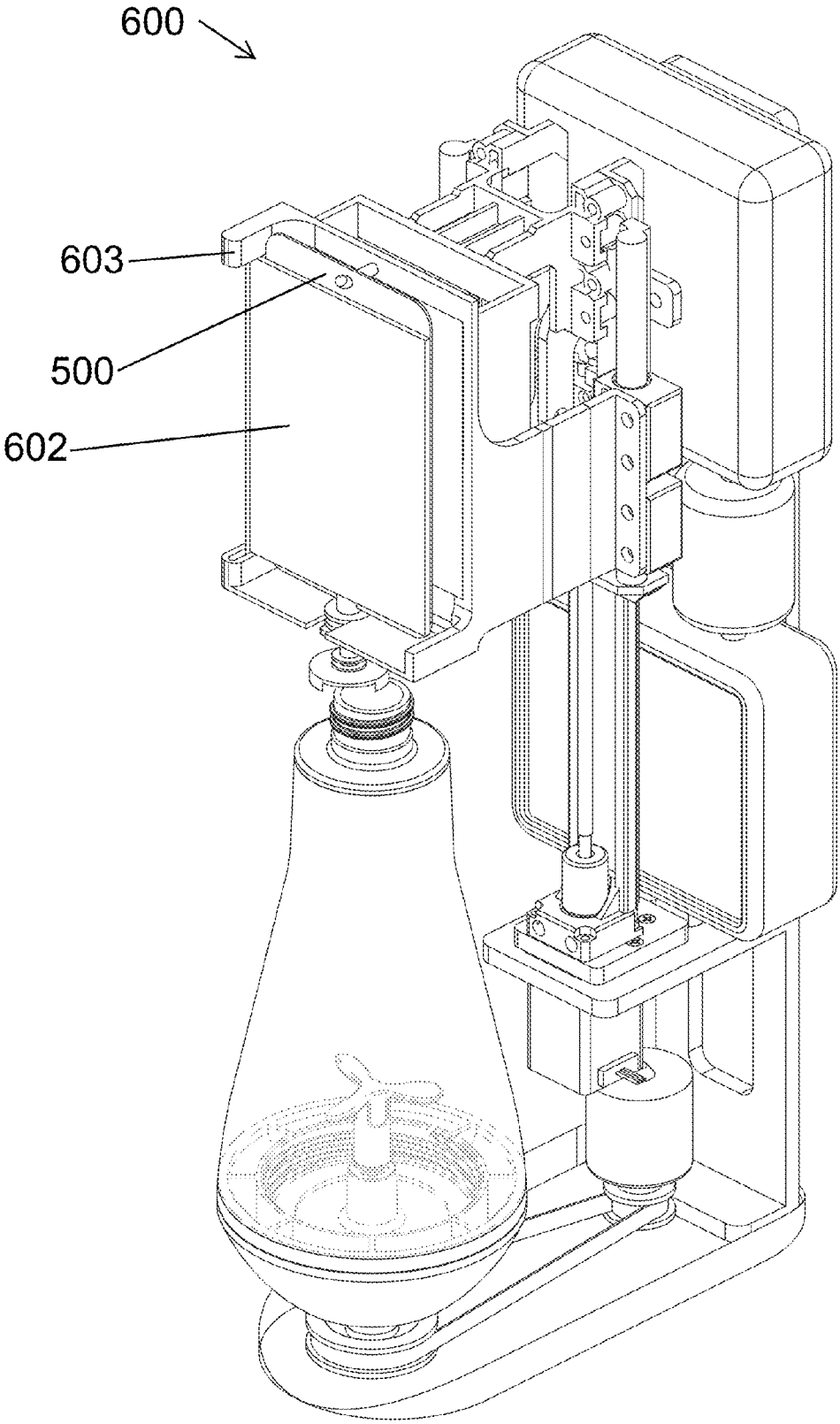

FIGS. 6A-6D are perspective views of a localized solution production unit for producing a solution from a concentrate pod including a pressing pod dock. Localized solution production unit 600 is substantially similar to localized solution production unit 100, but includes a distinct pod dock 603. The pod dock 603 is configured to press a flexible pouch pod, such as pod 500, rather than plunge a rigid cylinder pod like pod dock 103. The pod dock 603 includes a press chamber 601, a press 602, a pod hook 604, and a pod outlet 605. As shown in FIG. 6B, a pod 500 is hung in the press chamber 601 via the pod hook 604 extending through aperture 505. The spout 501, which can include a rigid tube, extends through a dock outlet 605 so that spout collar 502 and apertures 504 are positioned outside of the pod dock 603. As shown in FIG. 6C, the pod press 602 is closed, and as shown in FIG. 6D, the pod press 602 slides in the pod dock 603 to press or squeeze the pod 500 so that the concentrate exits the pod 500 via apertures 504 when the spout collar 502 is slidably moved on the spout 501 while pressed against neck 202 of the mixing container 203.

Figure 6G:
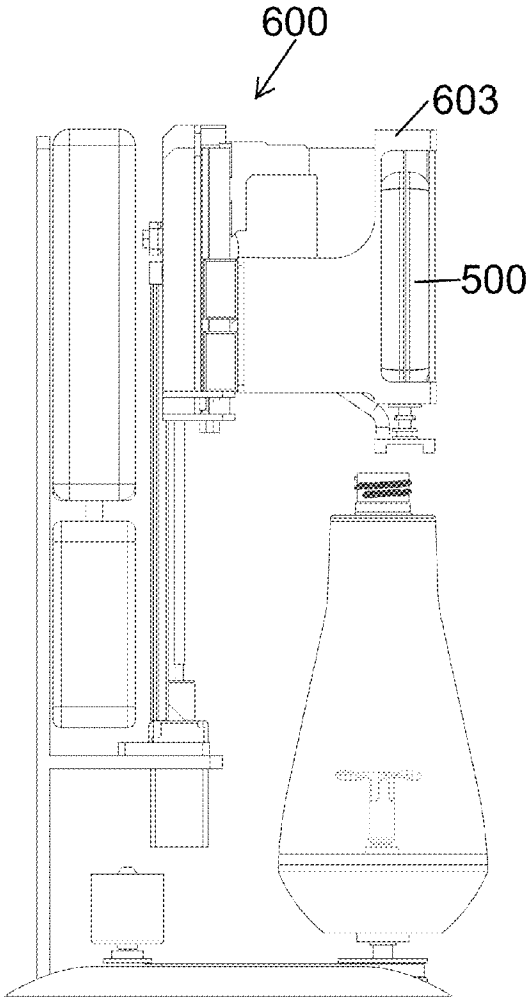
FIGS. 6E and 6G are side views of the localized solution production unit of FIGS. 6A-6D.
Figure 6F:
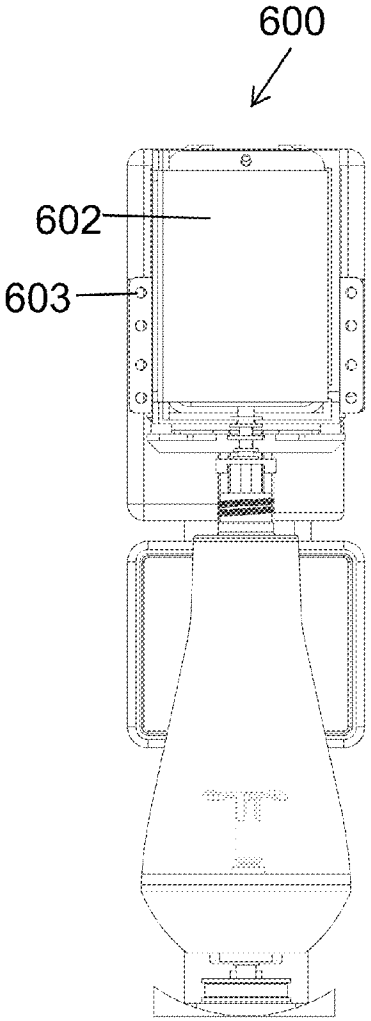
FIG. 6F is a front view of the localized solution production unit of FIGS. 6A-6D.
Figure 6E:
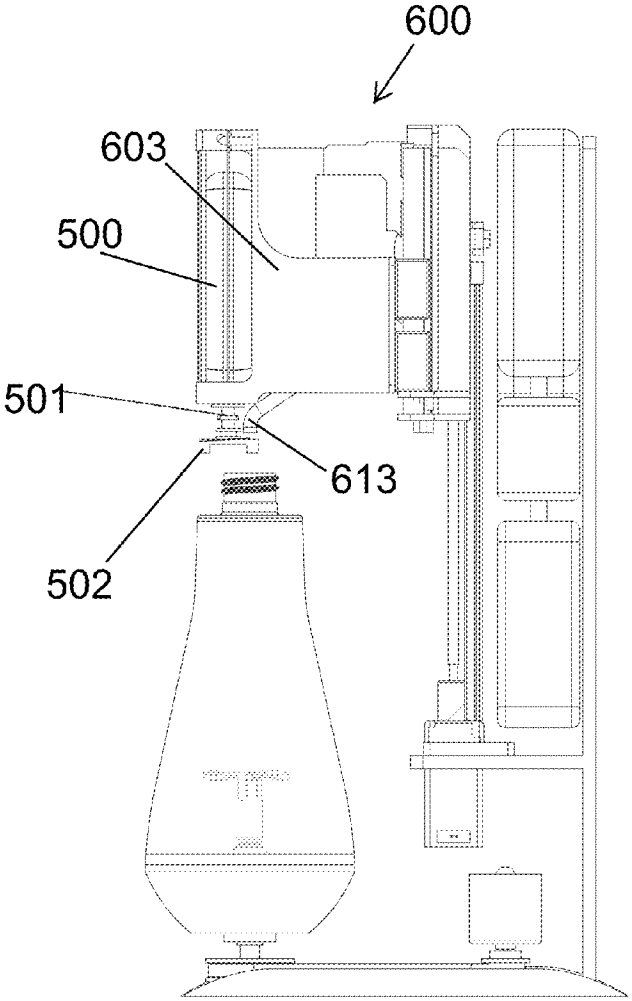

FIGS. 6E and 6G are side views of the localized solution production unit of FIGS. 6A-6D. The water spout 613 is shown in FIG. 6E.

FIG. 6F is a front view of the localized solution production unit of FIGS. 6A-6D.

Figure 7A:
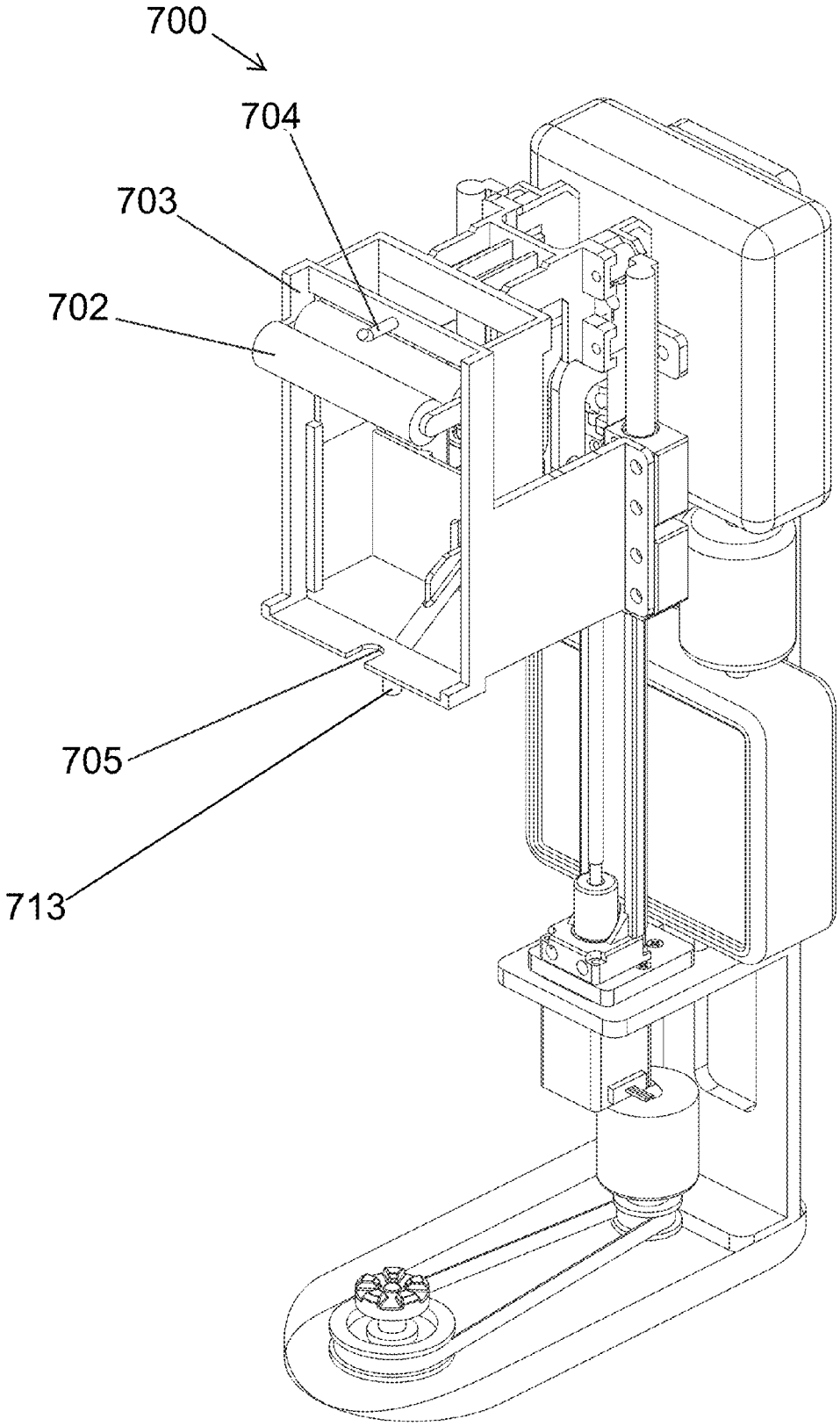
FIGS. 7A-7C are perspective views of a localized solution production unit for producing a solution from a concentrate pod including a rolling pod dock.
Figure 7B:
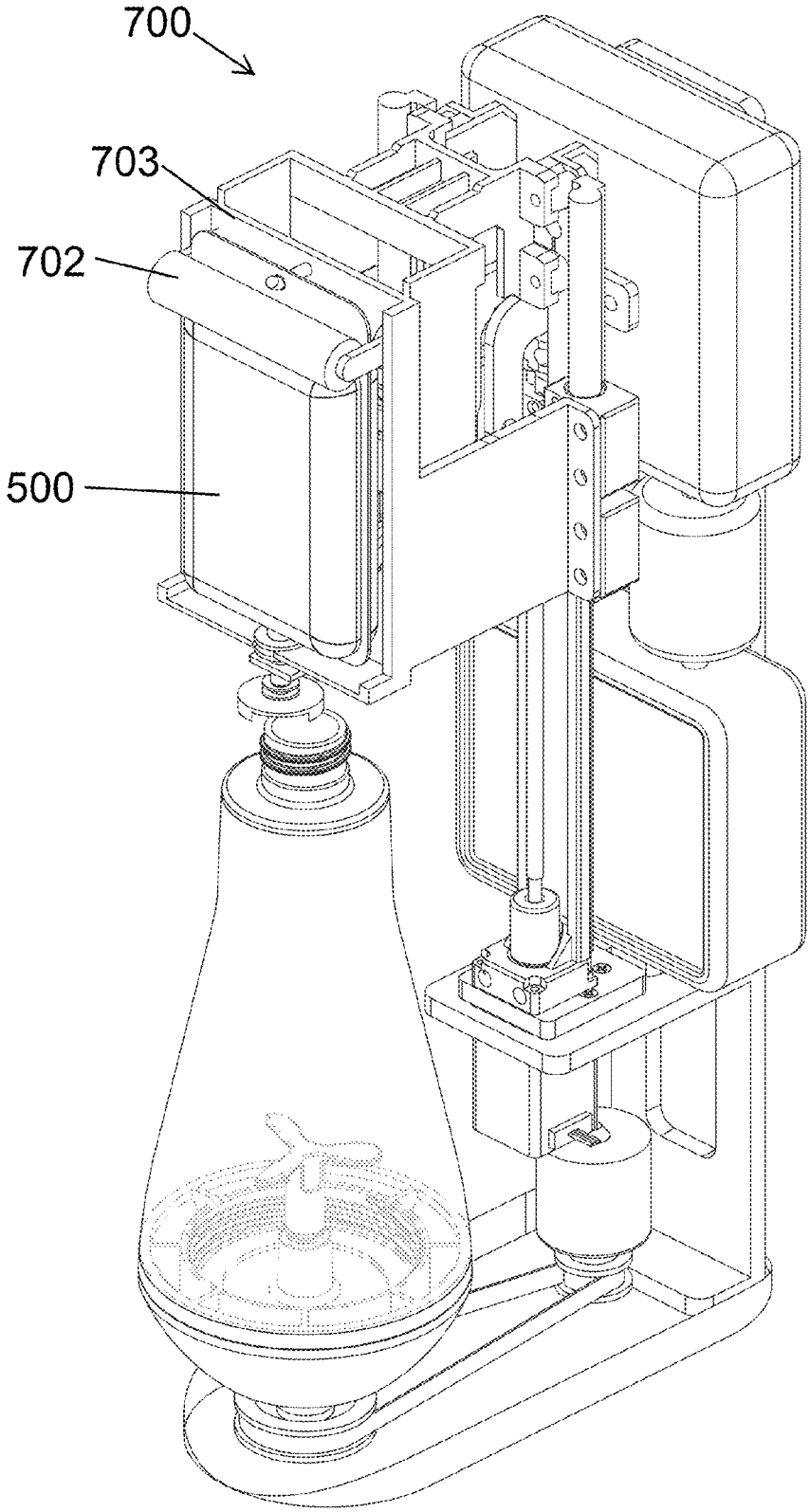
Figure 7C:
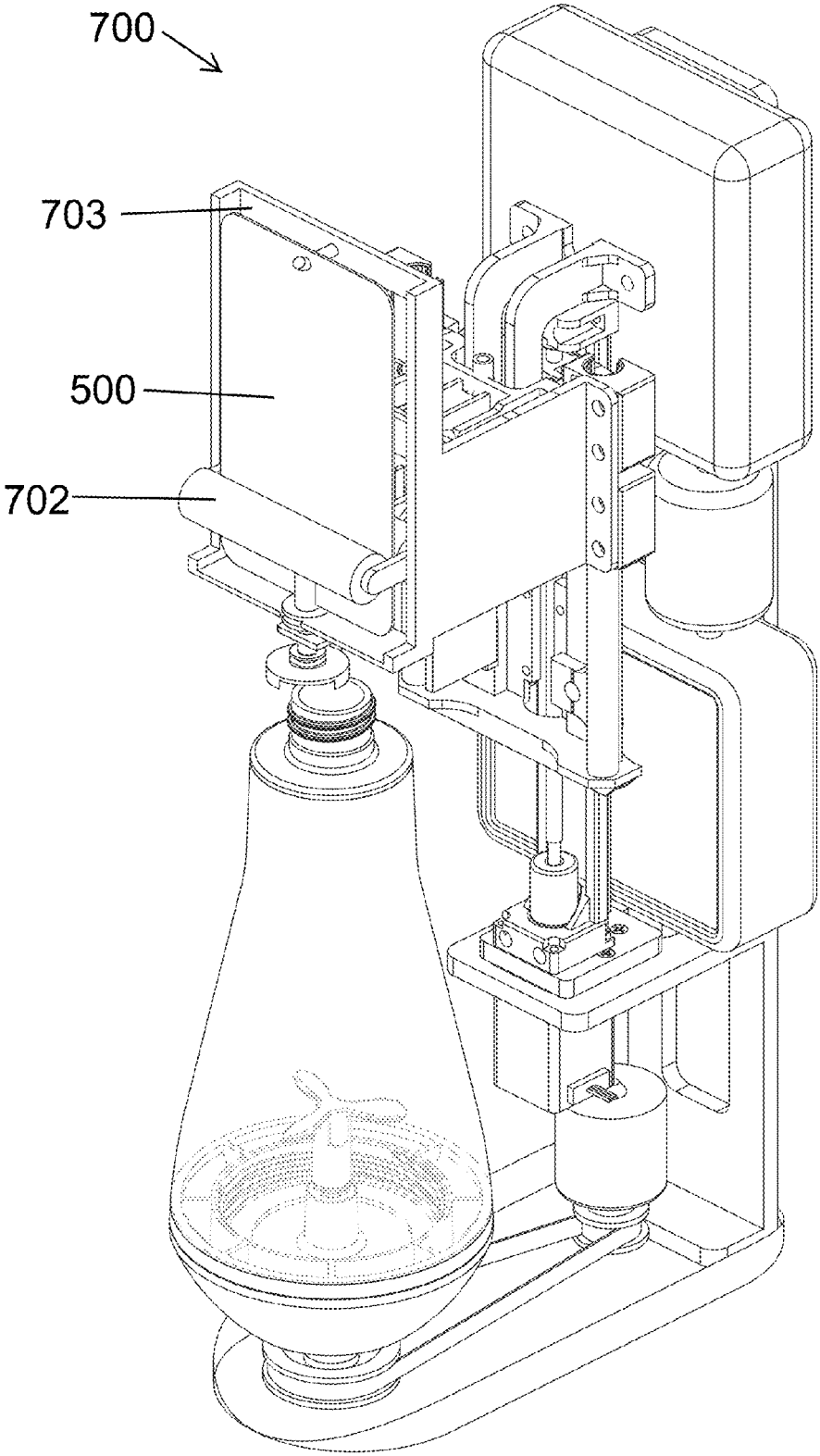

FIGS. 7A-7C are perspective views of a localized solution production unit for producing a solution from a concentrate pod including a rolling pod dock.

Localized solution production unit 700 is substantially similar to localized solution production unit 100, but includes a distinct pod dock 703. The pod dock 703 is configured to press a pod, such as pod 500 via roller 702. The pod dock 703 includes a pod hook 704. As shown in FIG. 7B, a pod 500 is hung in the pod dock 703 via the pod hook 704 extending through aperture 505. The spout 501, which can include a rigid tube, extends through a dock outlet 705 so that collar 502 and apertures 504 are positioned outside of the pod dock 703. As shown in FIG. 7C, the pod roller 702 is positioned at a top of the pod 500 and as shown in FIG. 7D the pod roller 702 rolls in the pod dock 703 to press or squeeze the pod 500 as it rolls down the pod 500 so that the concentrate exits the pod 500 via apertures 504 when the collar 502 is slidably moved on the spout 501 while pressed against neck 202 of the mixing container 203. The solution production unit 700 includes a water spout 713 for dispensing the base fluid into a mixing container. The water spout 713 can be configured to retract during dispensing of concentrate from a concentrate pod, but can be configured to move with the pod dock 703 when the height of the pod dock is adjusted to accommodate mixing containers of different sizes.

Figure 7F:
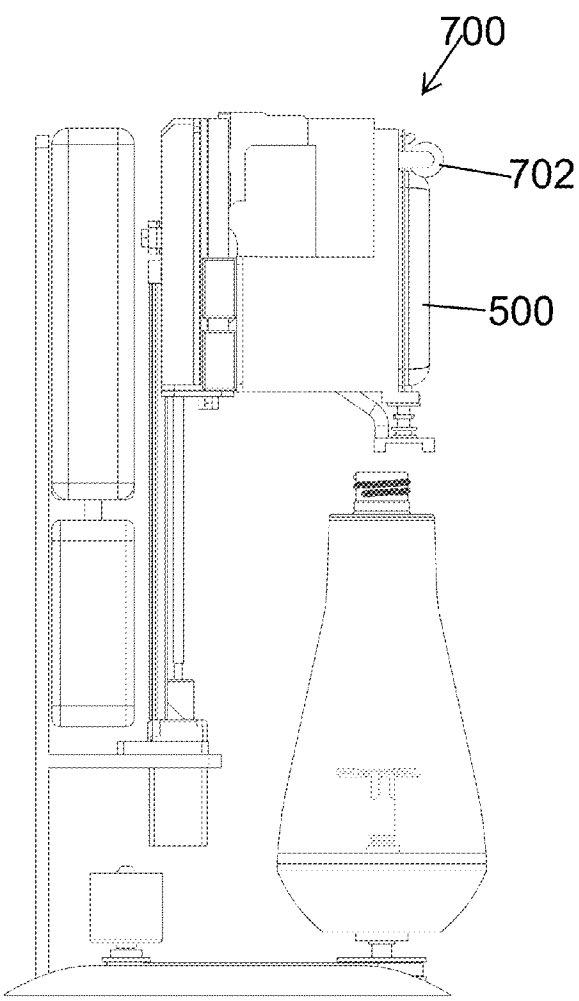
FIGS. 7D and 7F are side views of the localized solution production unit of FIGS. 7A-7C.
Figure 7E:
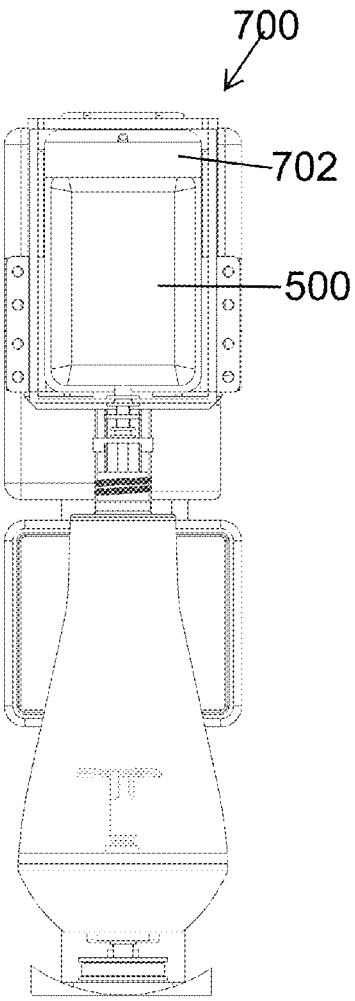
FIG. 7E is a front view of the localized solution production unit of FIGS. 7A-7C.
Figure 7D:
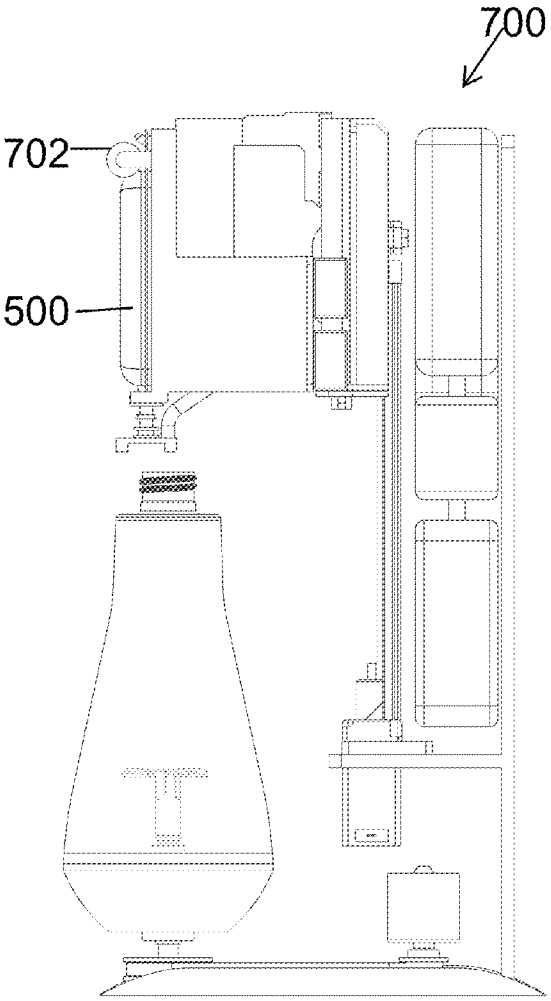

FIGS. 7D and 7F are side views of the localized solution production unit of FIGS. 7A-7C.

FIG. 7E is a front view of the localized solution production unit of FIGS. 7A-7C.

Figure 8A:
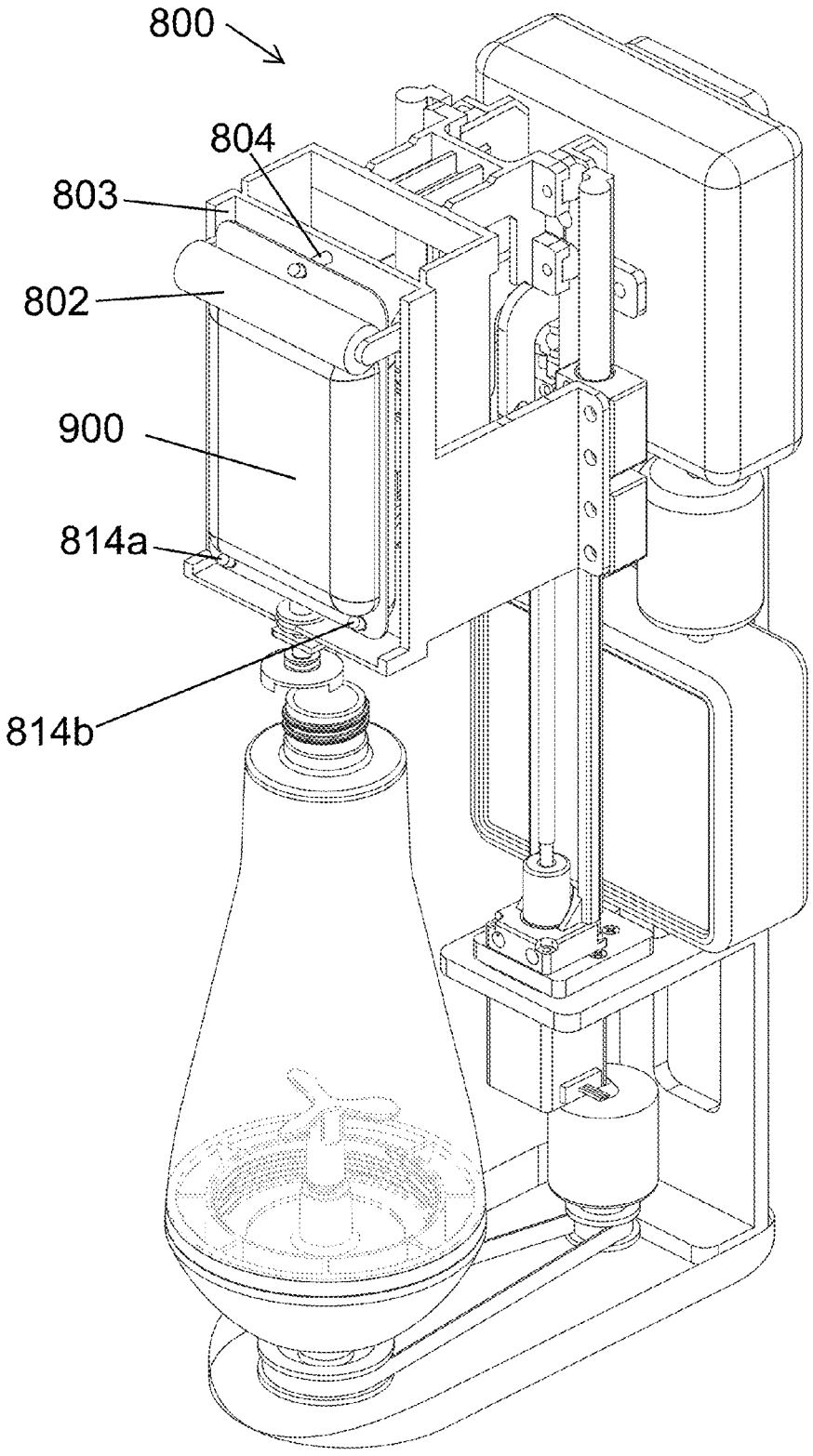
FIG. 8A is a perspective view of another localized solution production unit for producing a solution from a concentrate pod including a rolling pod dock.

FIG. 8A is perspective views of another localized solution production unit for producing a solution from a concentrate pod including a rolling pod dock. FIGS. 8A and 8B show a pod dock 803 configured to hold a pod 900 at a top and bottom via pod hooks 804 and 814*a* and 814*b*.

Figure 8D:
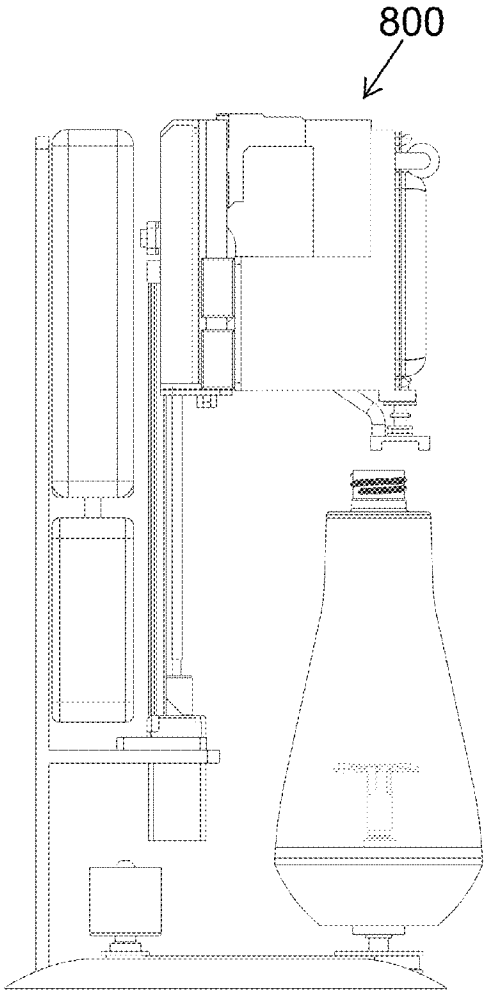
FIGS. 8B and 8D are side views of the localized solution production unit of FIG. 8A.
Figure 8C:
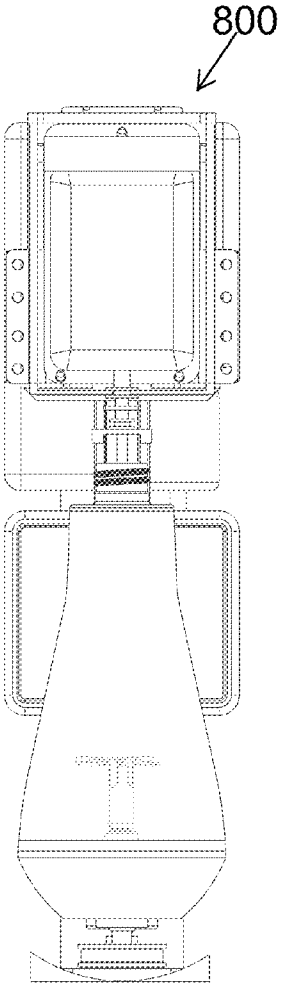
FIG. 8C is a front view of the localized solution production unit of FIG. 8A.
Figure 8B:
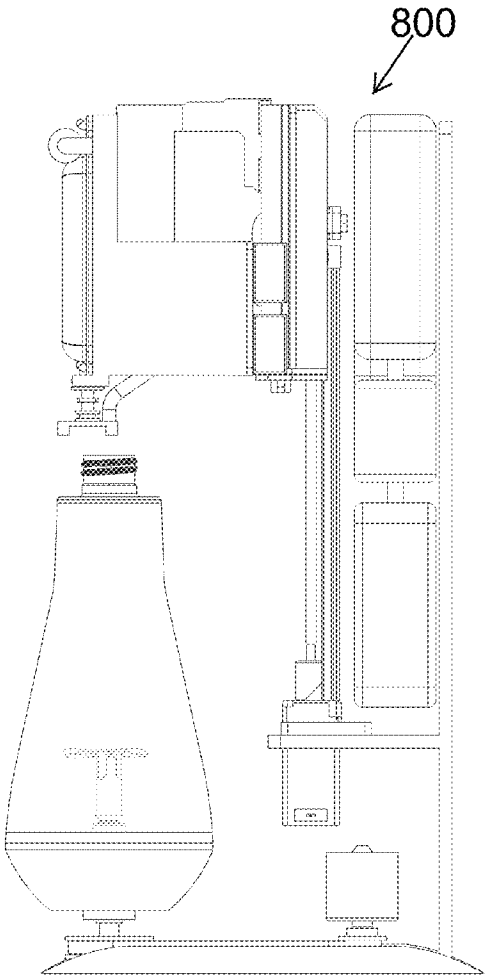

FIGS. 8B and 8D are side views of the localized solution production unit of FIG. 8A.

FIG. 8E is a front view of the localized solution production unit of FIG. 8A.

Figure 9A:
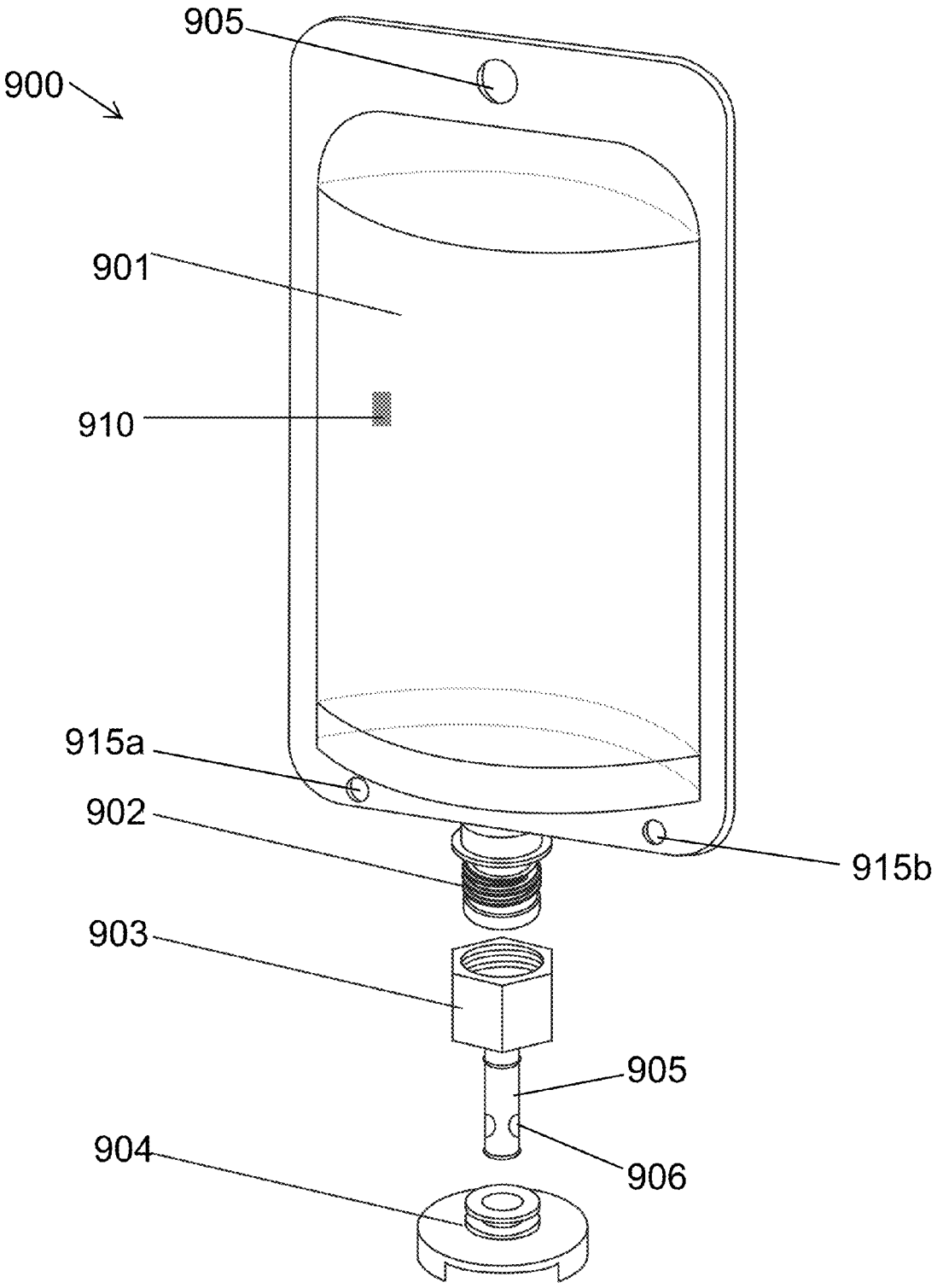
FIG. 9A is a front exploded view of a concentrate pod, in accordance with various embodiments.

FIG. 9A is a front exploded view of a concentrate pod in accordance with various embodiments. Concentrate pod 900 includes a pouch portion having a different geometric shape than pouch 500 and also includes suspension apertures 905 and 915*a* and 915*b* at top and bottom portion of the pouch 900. Additionally, the pod 900 includes a screw on spout fitment 903 configured to threadably engage pod neck 902. The screw on spout fitment 903 is integrally connected to pod spout 905, which includes pod outlet apertures 906. A spout collar 904 slidably engages on pod spout 905 to seal or reveal pod apertures 906. The concentrate pod 900 can include a tag 910, such as an RFID tag, a scanable code, or other indicia that can be detected, read, or identified by a detection device when the pod 900 is positioned in the pod dock.

Figure 9B:
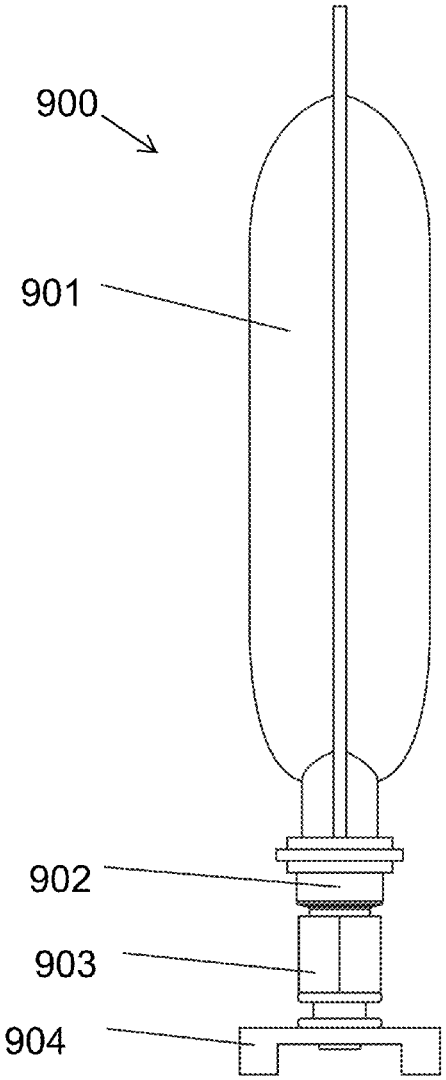
FIG. 9B is a side assembled view of the concentrate pod of FIG. 9A.

FIG. 9B is a side view of the concentrate pod of FIG. 9A.

Figure 9C:
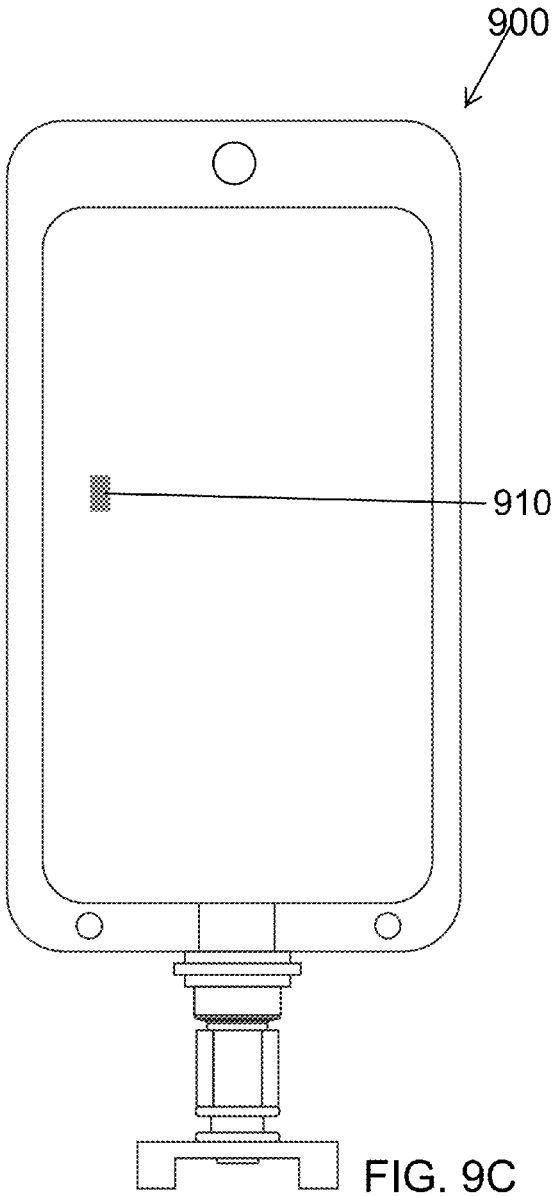
FIG. 9C is a front assembled view of the concentrate pod of FIG. 9A.

FIG. 9C is a front assembled view of the concentrate pod of FIG. 9A.

Figure 9D:
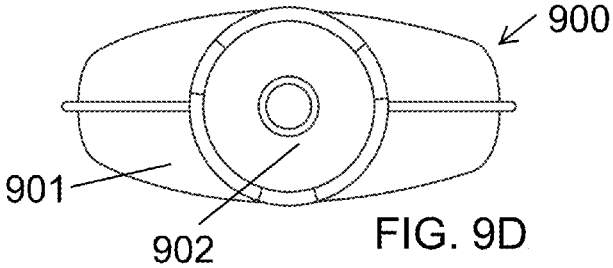
FIG. 9D is a bottom assembled view of the concentrate pod of FIG. 9A.

FIG. 9D is a bottom view of the concentrate pod of FIG. 9A.

FIG. 9B is a side view of the concentrate pod of FIG. 9A.

Figures 10A, 10B, 10C, 10D, 10E:
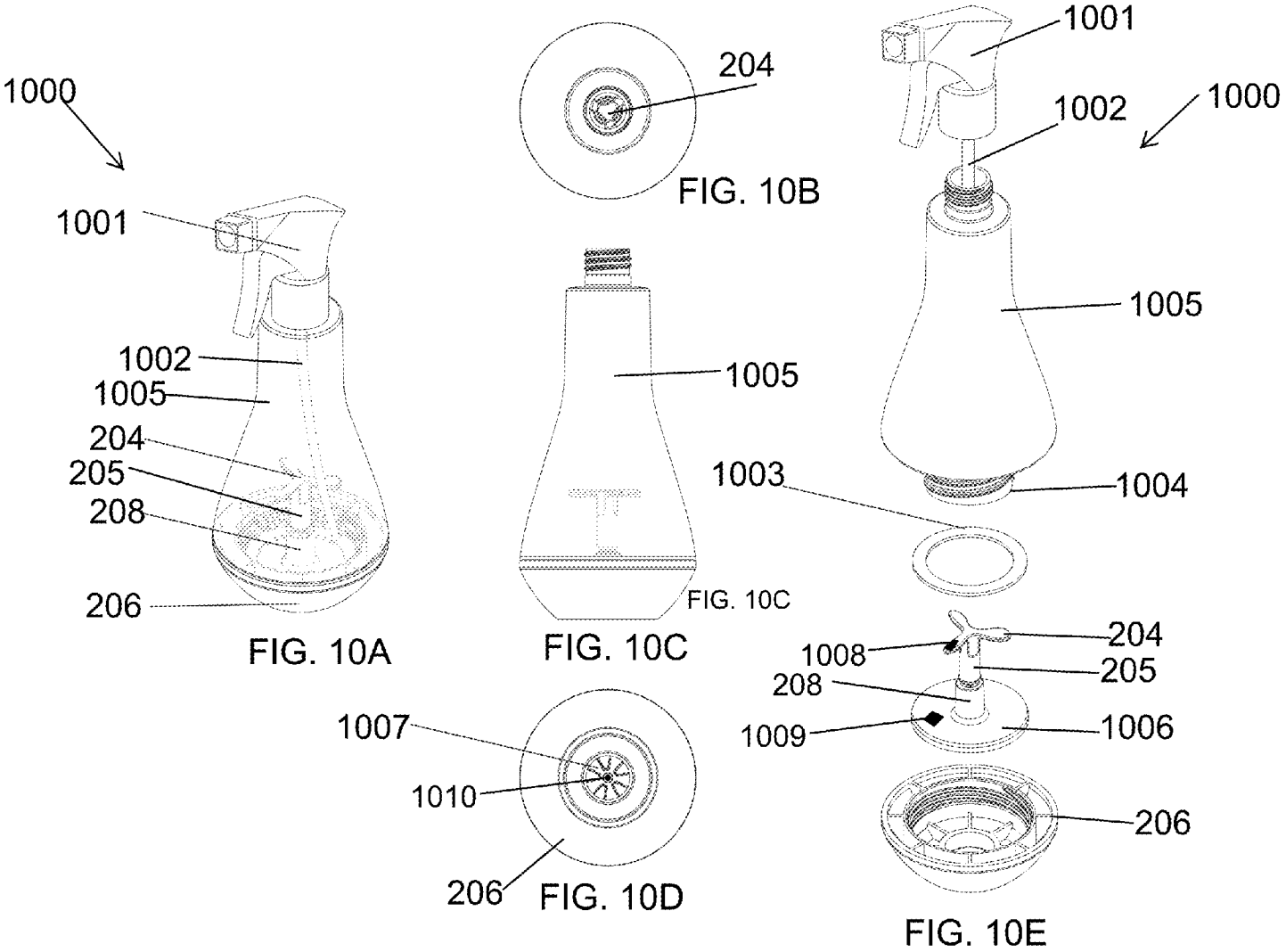
FIG. 10A is an assembled view of a mixing container, in accordance with various embodiments.
FIG. 10B is a top assembled view of the mixing container of FIG. 10A with the spray dispenser removed.
FIG. 10C is a side assembled view of the mixing container of FIG. 10A with the spray dispenser removed.
FIG. 10D is a bottom assembled view of the mixing container of FIG. 10A with the spray dispenser removed.
FIG. 10E is an exploded view of the mixing container of FIG. 10A.

FIG. 10A is an assembled view of a mixing container 1000 including a spray dispenser attached thereto in accordance with various embodiments. The mixing container 203 includes a spray dispenser 1001 coupled to the neck 202 of the mixing container. The spray dispenser 1001 is a trigger sprayer and extracts solution from the mixing container 203 via a dip tube 1002. The mixing container includes the mixing container base 206. In certain embodiments, the dip tube can be configured to engage with an opening in the impeller and mixing shaft where the mixing shaft includes a hollowed portion so as to form an extension of the dip tube so that solution can be extracted from the bottom of the shaft. In certain embodiments, the dip tube 1002 can be flexible to allow for bending of the tube to avoid contact with the impeller as shown in FIG. 10A.

FIG. 10C is a side view of the mixing container of FIG. 10A with the spray dispenser removed.

FIG. 10D is a bottom view of the mixing container of FIG. 10A with the spray dispenser removed. As shown in FIG. 10D, the mixing base 206 includes a rotatable coupling 1007 configured to matingly engage with the impeller drive (i.e. impeller drive 112).

FIG. 10E is an exploded view of the mixing container of FIG. 10A. As shown in FIG. 10E the mixing container base 206 is removably coupled to the mixing container body 1005 via threaded base 1004 threadably engaged with the base 206. A base gasket 1003 is positioned between the impeller base portion 1006 and the container body 1005 to provide a seal therebetween. In particular, the gasket 1003 is sealed between impeller base portion 1006 attached to impeller shaft 205 and the mixing container body 1005 when the impeller base portion 1006 is seated in base 206. As illustrated in FIG. 10E, in certain embodiments, the impeller and the base portion 1006 can include electrical contacts 1008 and 1009 respectively, configured to close a circuit when a base fluid contacts both in order to signal to the controller 115 that the impeller is submerged in the base fluid. At least one of the contacts 1008 and 1009 can be electrically coupled to a signal transmitter activated by the circuit between the two contacts 1008 and 1009 being closed by the base fluid. As illustrated in FIG. 10E, in certain embodiments, the mixing container 1000 includes a tag 1010 that can be positioned in the base 206 of the mixing container 1000. The tag 1010 can provide information such as a height of the mixing container 1000, a volume of the mixing container, or other information, such as an identification of the solution to be mixed in the mixing container 1000 or that has been mixed in the mixing container. In certain embodiments, the tag 1010 is an electronic tag, while in other embodiments the tag 1010 may include a printed or machine readable code.

FIG. 10B is a top view of the mixing container of FIG. 10A with the spray dispenser removed.

Figure 11E:
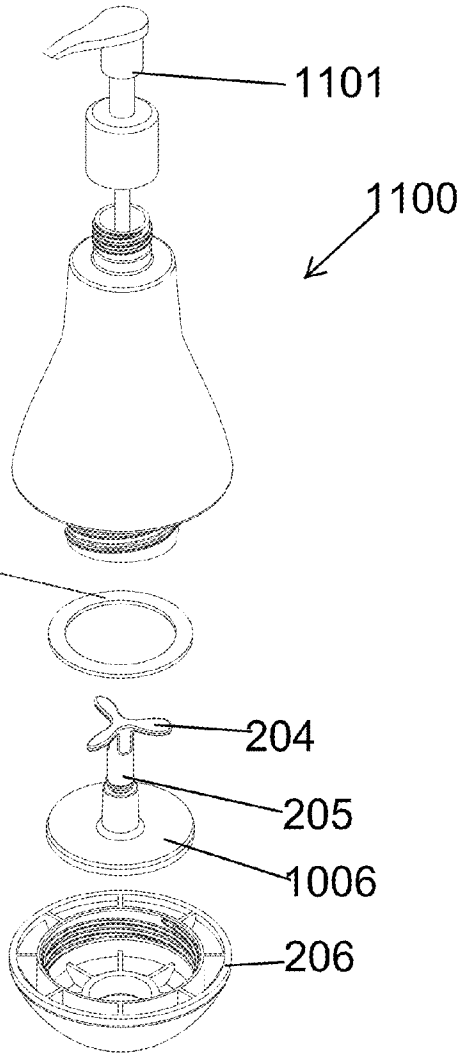
FIG. 11E is an exploded view of the mixing container of FIG. 11A.
Figure 11B:
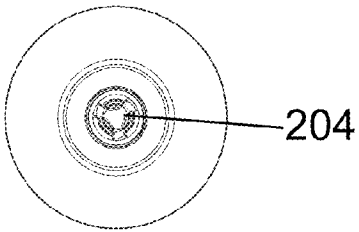
FIG. 11B is a top assembled view of the mixing container of FIG. 11A with the pump dispenser removed.
Figure 11C:
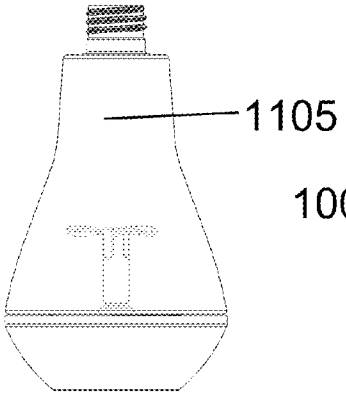
FIG. 11C is a side assembled view of the mixing container of FIG. 11A with the pump dispenser removed.
Figure 11D:
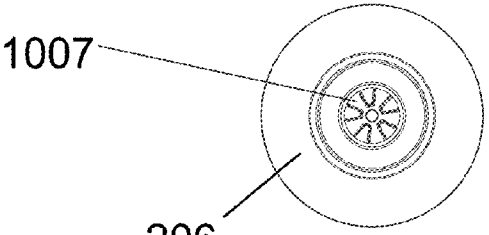
FIG. 11D is a bottom assembled view of the mixing container of FIG. 11A with the pump dispenser removed.
Figure 11A:
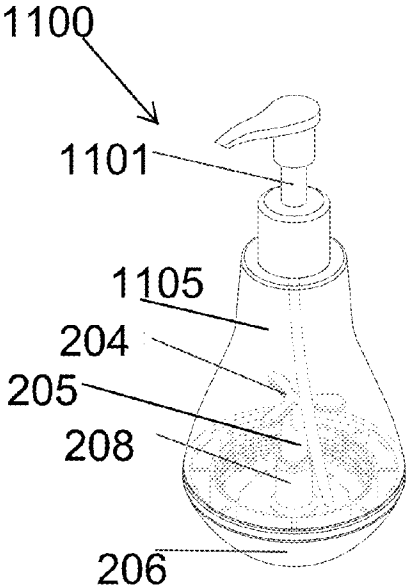
FIG. 11A is an assembled view of a mixing container, in accordance with various embodiments.

FIG. 11A is an assembled view of a mixing container in accordance with various embodiments. The mixing container 1100 includes a body portion 1105 that is substantially similar to body 1005 of mixing container 1000 and is engaged to the same base portion 206. The mixing container 1100 includes a pump dispenser 1101, that can be used to dispense a solution such as soap.

FIG. 11B is a top view of the mixing container of FIG. 11A with the pump dispenser removed.

FIG. 11C is a side view of the mixing container of FIG. 11A with the pump dispenser removed.

FIG. 11D is a bottom view of the mixing container of FIG. 11A with the pump dispenser removed. As shown in FIG. 11D, the mixing base 206 includes the rotatable coupling 1007 configured to matingly engage with the impeller drive (i.e. impeller drive 112).

FIG. 11E is an exploded view of the mixing container of FIG. 11A.

Figure 12E:
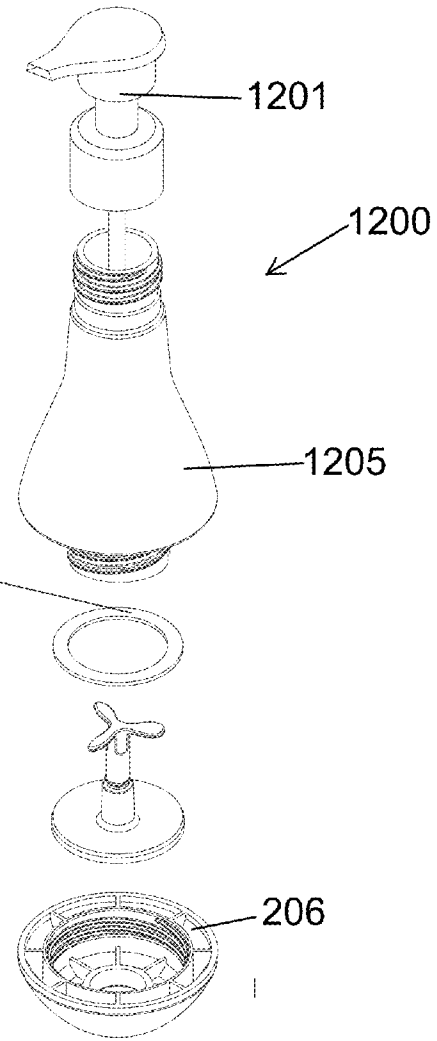
FIG. 12E is an exploded view of the mixing container of FIG. 12A.
Figure 12B:
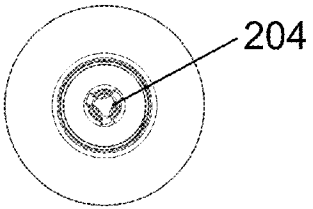
FIG. 12B is a top assembled view of the mixing container of FIG. 12A with the foaming pump dispenser removed.
Figure 12C:
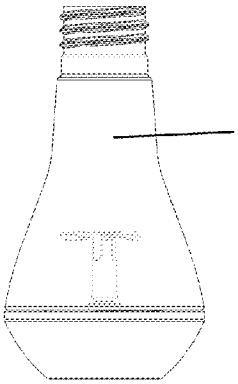
FIG. 12C is a side assembled view of the mixing container of FIG. 12A with the foaming pump dispenser removed.
Figure 12D:
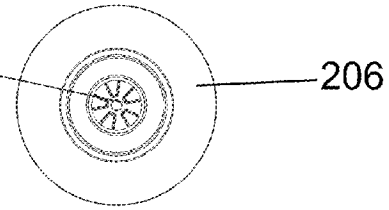
FIG. 12D is a bottom assembled view of the mixing container of FIG. 12A with the foaming pump dispenser removed.
Figure 12A:
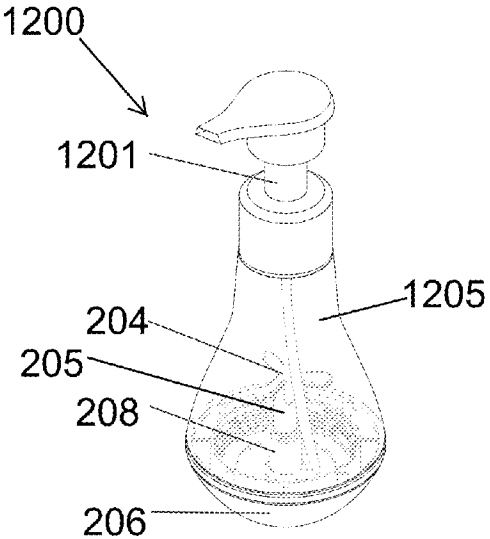
FIG. 12A is an assembled view of a mixing container, in accordance with various embodiments.

FIG. 12A is an assembled view of a mixing container, in accordance with various embodiments. The mixing container 1200 includes a body portion 1205 that is substantially similar to bodies 1005 and 1105 of mixing containers 1000 and 1100 respectively and is engaged to the same base portion 206. The mixing container 1200 includes a foaming pump dispenser 1201, that can be used to dispense a solution such as a foaming soap.

FIG. 12B is a top view of the mixing container of FIG. 12A with the foaming pump dispenser removed.

FIG. 12C is a side view of the mixing container of FIG. 12A with the foaming pump dispenser removed.

FIG. 12D is a bottom view of the mixing container of FIG. 12A with the foaming pump dispenser removed. As shown in FIG. 12D, the mixing base 206 includes the rotatable coupling 1007 configured to matingly engage with the impeller drive (i.e. impeller drive 112).

FIG. 12E is an exploded view of the mixing container of FIG. 12A.

Figure 13E:
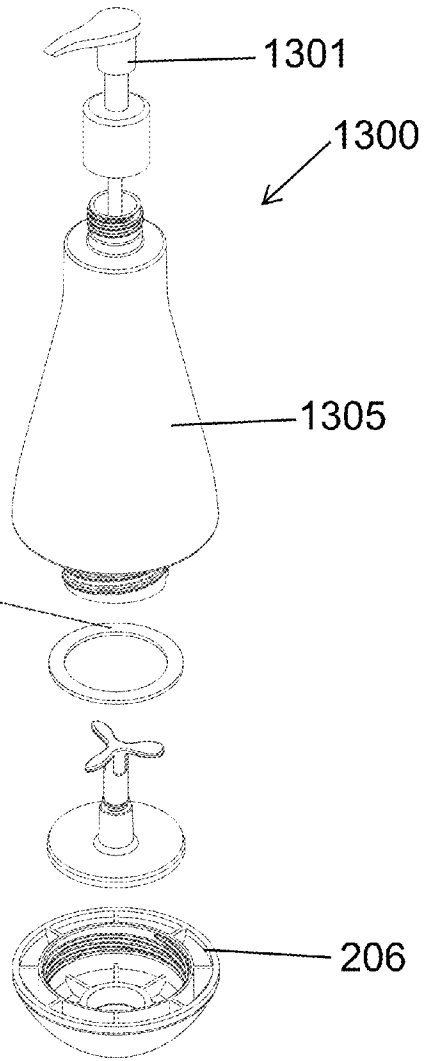
FIG. 13E is an exploded view of the mixing container of FIG. 13A.
Figure 13B:
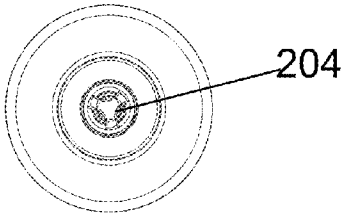
FIG. 13B is a top assembled view of the mixing container of FIG. 13A with the pump dispenser removed.
Figure 13C:
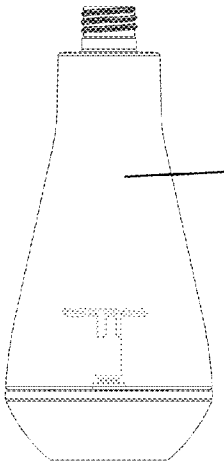
FIG. 13C is a side assembled view of the mixing container of FIG. 13A with the pump dispenser removed.
Figure 13D:
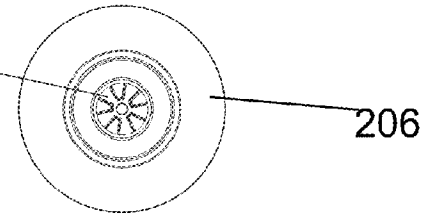
FIG. 13D is a bottom assembled view of the mixing container of FIG. 13A with the pump dispenser removed.
Figure 13A:
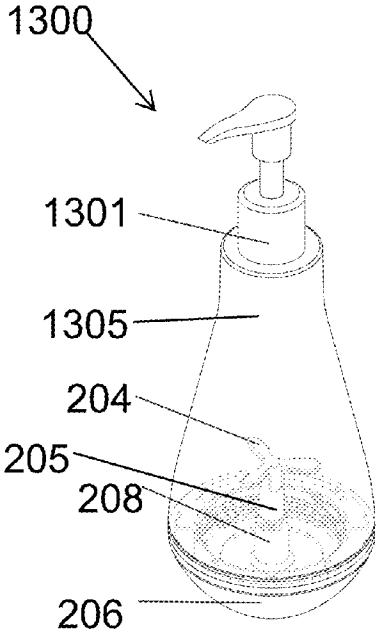
FIG. 13A is an assembled view of a mixing container, in accordance with various embodiments.

FIG. 13A is an assembled view of a mixing container, in accordance with various embodiments. The mixing container 1300 includes an elongated body portion 1305 that is taller than body 1005 of mixing container 1000, but that is engaged to the same base portion 206. The mixing container 1300 includes a pump dispenser, that can be used to dispense a solution such as soap or laundry detergent.

FIG. 13B is a top view of the mixing container of FIG. 13A with the pump dispenser removed.

FIG. 13C is a side view of the mixing container of FIG. 13A with the pump dispenser removed.

FIG. 13D is a bottom view of the mixing container of FIG. 13A with the pump dispenser removed. As shown in FIG. 13D, the mixing base 206 includes the rotatable coupling 1007 configured to matingly engage with the impeller drive (i.e. impeller drive 112).

FIG. 13E is an exploded view of the mixing container of FIG. 13A.

Figure 14E:
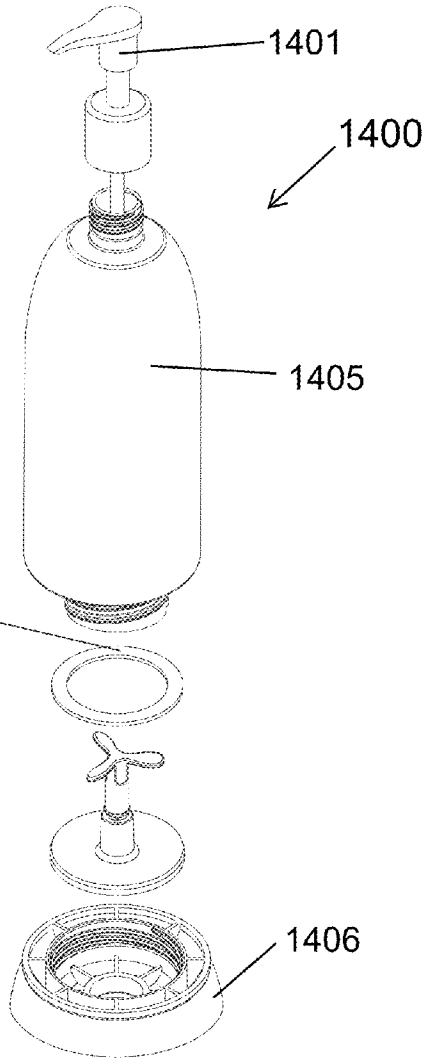
FIG. 14E is an exploded view of the mixing container of FIG. 14A.
Figure 14B:
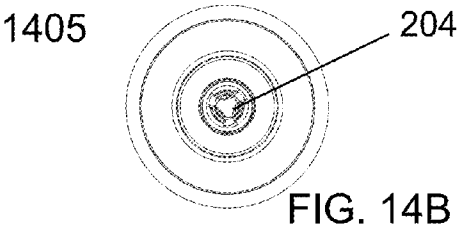
FIG. 14B is a top assembled view of the mixing container of FIG. 14A with the pump dispenser removed.
Figure 14C:
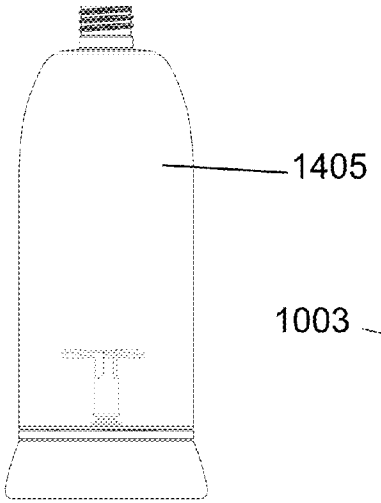
FIG. 14C is a side assembled view of the mixing container of FIG. 14A with the pump dispenser removed.
Figure 14D:
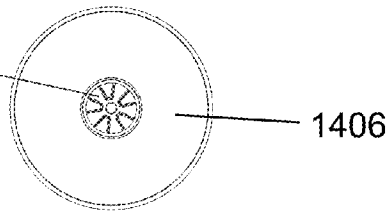
FIG. 14D is a bottom assembled view of the mixing container of FIG. 14A with the pump dispenser removed.
Figure 14A:
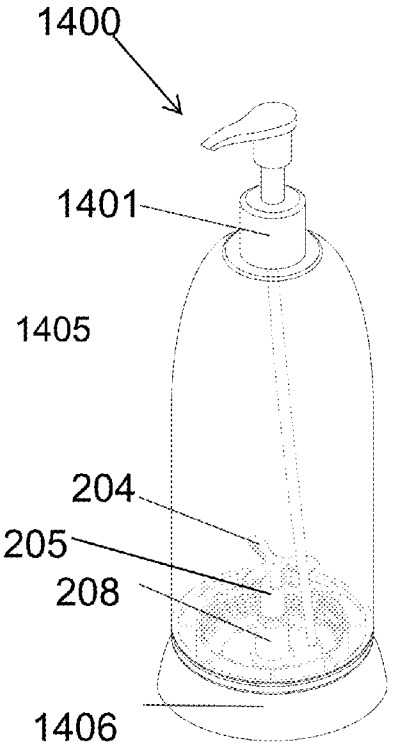
FIG. 14A is an assembled view of a mixing container, in accordance with various embodiments.

FIG. 14A is an assembled view of a mixing container, in accordance with various embodiments. The mixing container 1400 includes a body portion 1405 that with a widened base and a widened top with respect to body 1005 of mixing container 1000. The mixing container 1400 includes a widened base portion 1406 having a flared rather than a tapered bottom. The mixing container 1400 can be used to retain and dispense solutions at greater volumes.

FIG. 14B is a top view of the mixing container of FIG. 14A with the pump dispenser removed.

FIG. 14C is a side view of the mixing container of FIG. 14A with the pump dispenser removed.

FIG. 14D is a bottom view of the mixing container of FIG. 14A with the pump dispenser removed. As shown in FIG.

14D, the mixing base 1406 includes the rotatable coupling 1007 configured to matingly engage with the impeller drive (i.e. impeller drive 112).

FIG. 14E is an exploded view of the mixing container of FIG. 14A.

Figure 15E:
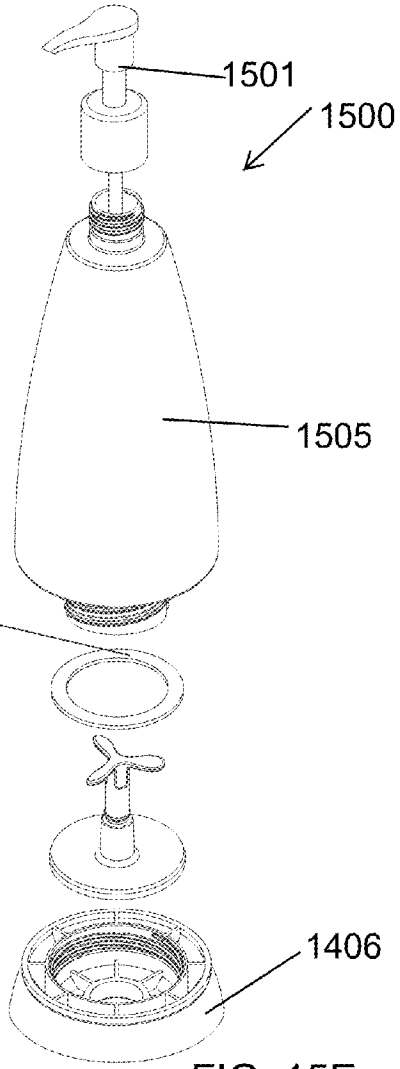
FIG. 15E is an exploded view of the mixing container of FIG. 15A.
Figure 15B:
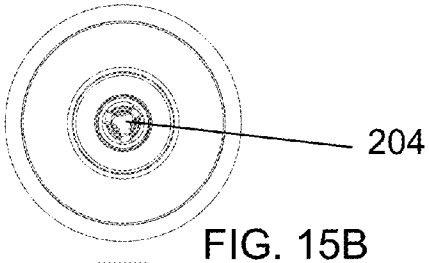
FIG. 15B is a top assembled view of the mixing container of FIG. 15A with the pump dispenser removed.
Figure 15C:
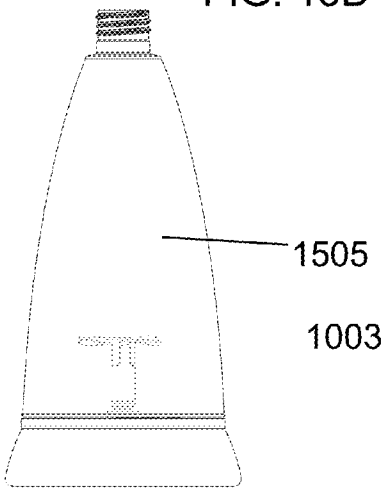
FIG. 15C is a side assembled view of the mixing container of FIG. 15A with the pump dispenser removed.
Figure 15D:
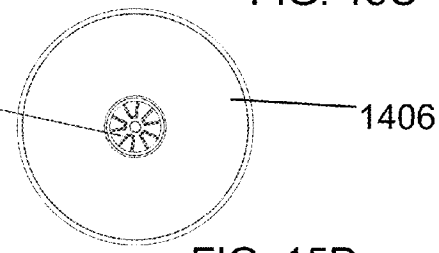
FIG. 15D is a bottom assembled view of the mixing container of FIG. 15A with the pump dispenser removed.
Figure 15A:
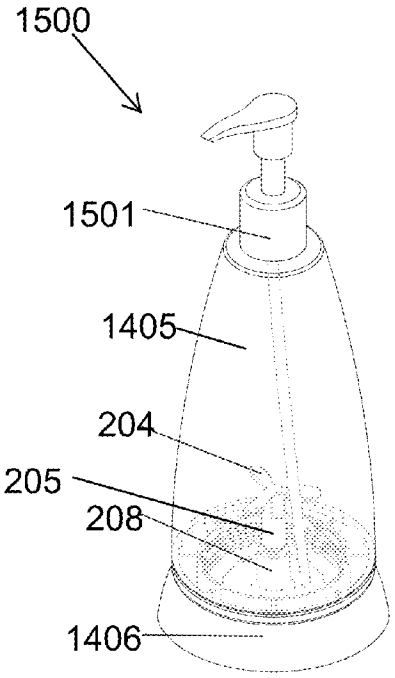
FIG. 15A is an assembled view of a mixing container in accordance with various embodiments.

FIG. 15A is an assembled view of a mixing container, in accordance with various embodiments. The mixing container 1500 includes a body portion 1505 with a widened base, but a narrower top portion than container 1400. The mixing container 1500 can be matingly engaged with the same base portion 1406 as the mixing container 1400.

FIG. 15B is a top view of the mixing container of FIG. 15A with the pump dispenser removed.

FIG. 15C is a side view of the mixing container of FIG. 15A with the pump dispenser removed.

FIG. 15D is a bottom view of the mixing container of FIG. 15A with the pump dispenser removed. As shown in FIG. 15D, the mixing base 1406 includes the rotatable coupling 1007 configured to matingly engage with the impeller drive (i.e. impeller drive 112).

FIG. 15E is an exploded view of the mixing container of FIG. 15A.

Figure 16E:
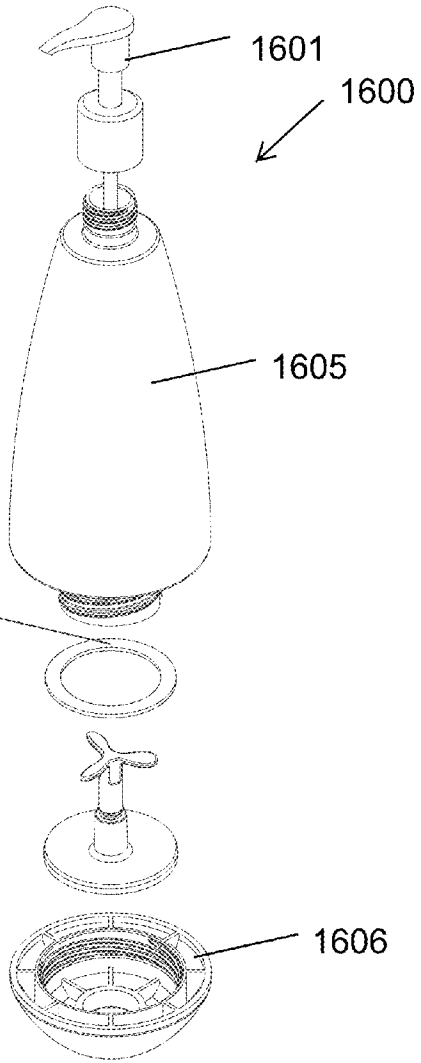
FIG. 16E is an exploded view of the mixing container of FIG. 16A.
Figure 16B:
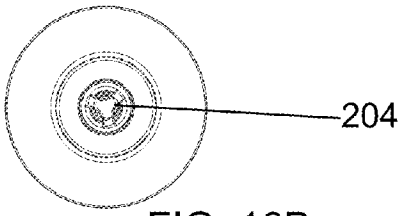
FIG. 16B is a top assembled view of the mixing container of FIG. 16A with the pump dispenser removed.
Figure 16C:
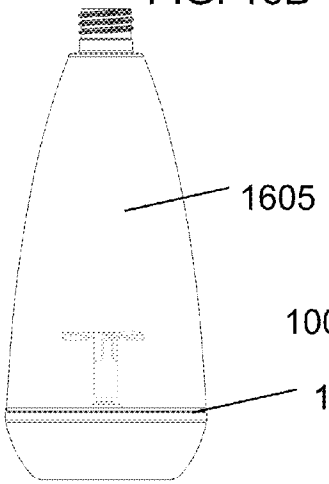
FIG. 16C is a side assembled view of the mixing container of FIG. 16A with the pump dispenser removed.
Figure 16D:
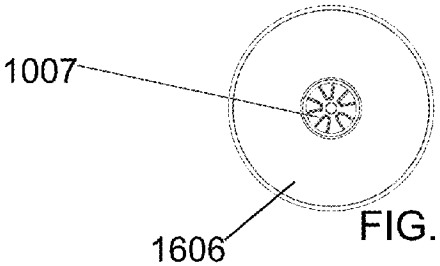
FIG. 16D is a bottom assembled view of the mixing container of FIG. 16A with the pump dispenser removed.
Figure 16A:
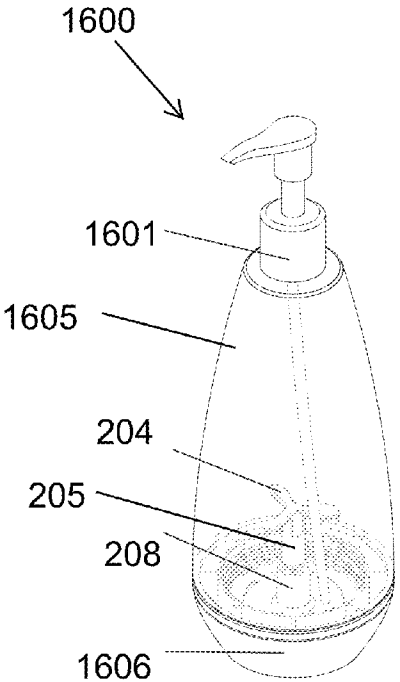
FIG. 16A is an assembled view of a mixing container, in accordance with various embodiments.

FIG. 16A is an assembled view of a mixing container, in accordance with various embodiments. The mixing container 1600 includes a body portion 1605 with a widened base, but a narrower top portion than container 1400 (in a manner similar to container 1500), but the mixing container 1600 is matingly engaged with the base portion 1606 that is wider than base portion 206, but is tapered at the bottom rather than flared at the bottom as base portion 1406.

FIG. 16B is a top view of the mixing container of FIG. 16A with the pump dispenser removed.

FIG. 16C is a side view of the mixing container of FIG. 16A with the pump dispenser removed.

FIG. 16D is a bottom view of the mixing container of FIG. 16A with the pump dispenser removed. As shown in FIG. 16D, the mixing base 1606 includes the rotatable coupling 1007 configured to matingly engage with the impeller drive (i.e. impeller drive 112).

FIG. 16E is an exploded view of the mixing container of FIG. 16A.

Figure 17:
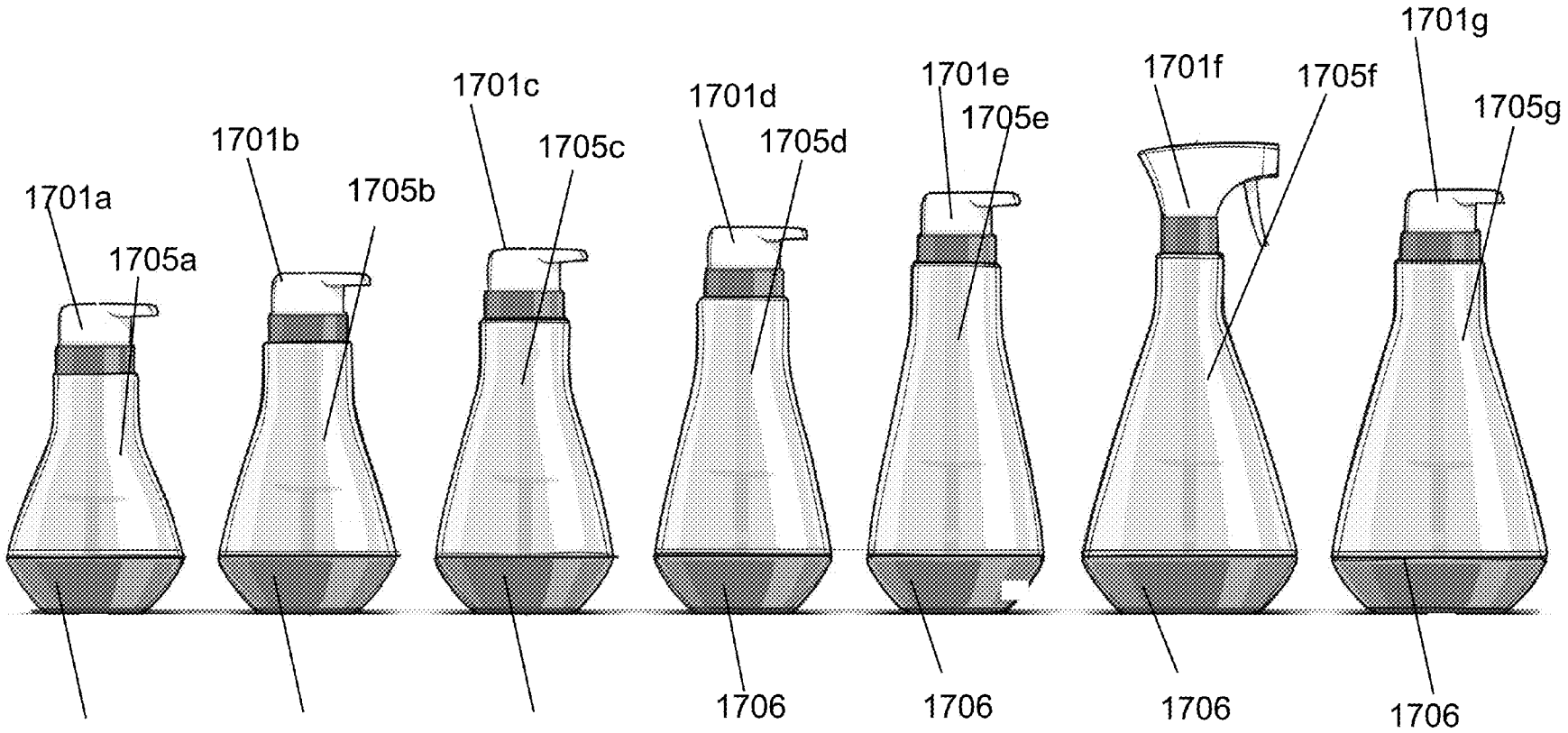
FIG. 17 illustrates a family of mixing containers, in accordance with various embodiments.

FIG. 17 illustrates a family of mixing containers, in accordance with various embodiments. As shown in FIG. 17, a family of mixing containers may include a plurality of different container bodies 1705*a*-1705*g* configured for coupling to the same base 1706 and configured for coupling to one or more different dispensers 1701*a*-1701*g*.

FIGS. 18A-18D are perspective views of a localized solution production unit for producing a solution from a multi-dose concentrate pod. The localized solution production unit 1800 is similar to the localized solution production unit 100, but includes one or more enlarged concentrate pods 1805, or a concentrate container, containing multiple doses of concentrate (rather than a single dose of concentrate as reflected in prior embodiments of the concentrate pods) and a direct water supply connection 1804 that eliminates the need for a reservoir. The production unit 1800 can be controlled to dose measured amounts of concentrate from the enlarged concentrate pod 1805 by a concentrate dispenser pump 1802 through concentrate outlet 1803. The production unit 1800 can be positioned in a kiosk system in a public location, such as in a retail location, rather than in a private location, such as in a home or office.

Figure 18A:
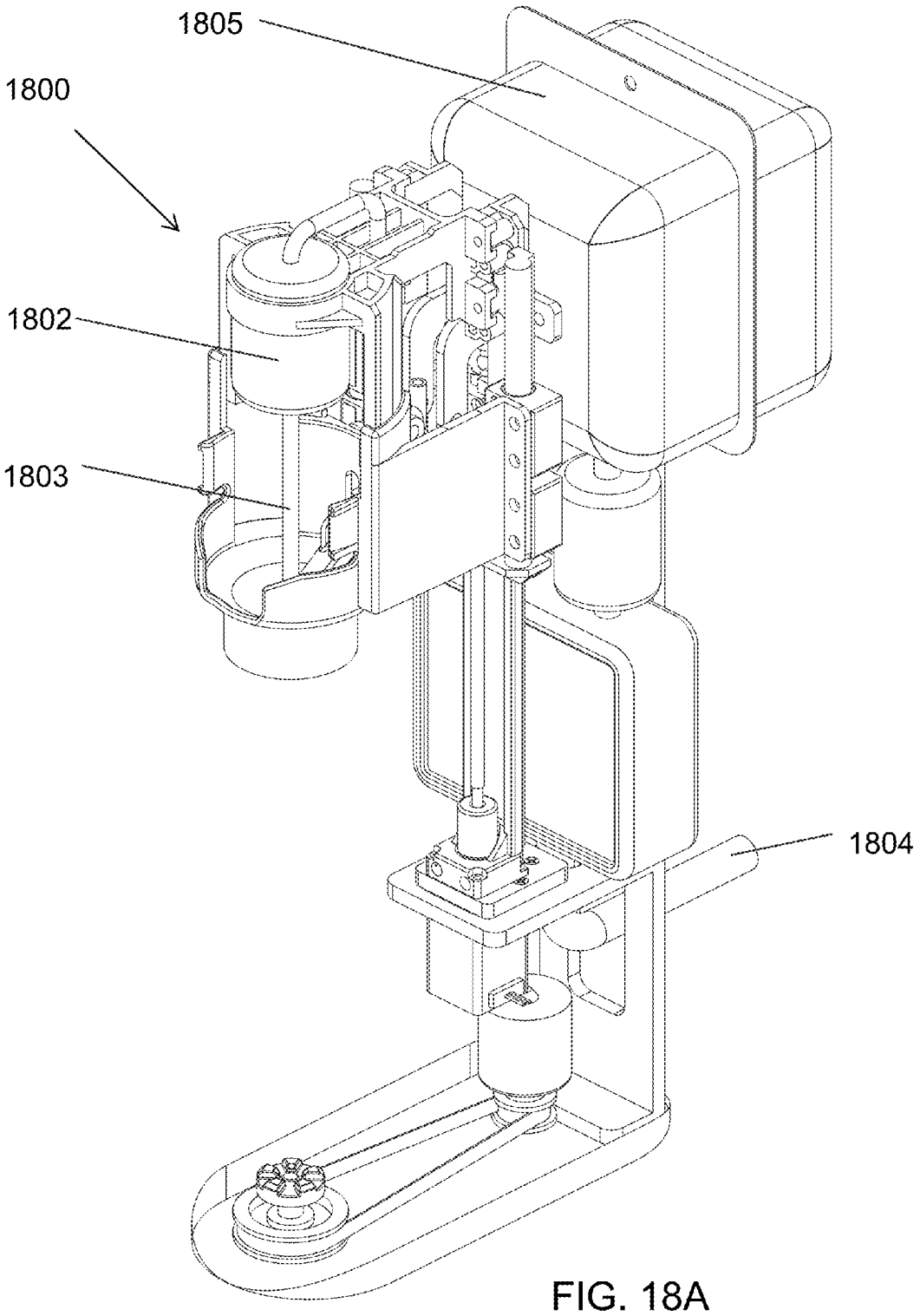
FIGS. 18A-18D are perspective views of a localized solution production unit for producing a solution from a multi-dose concentrate pod.
Figure 18B:
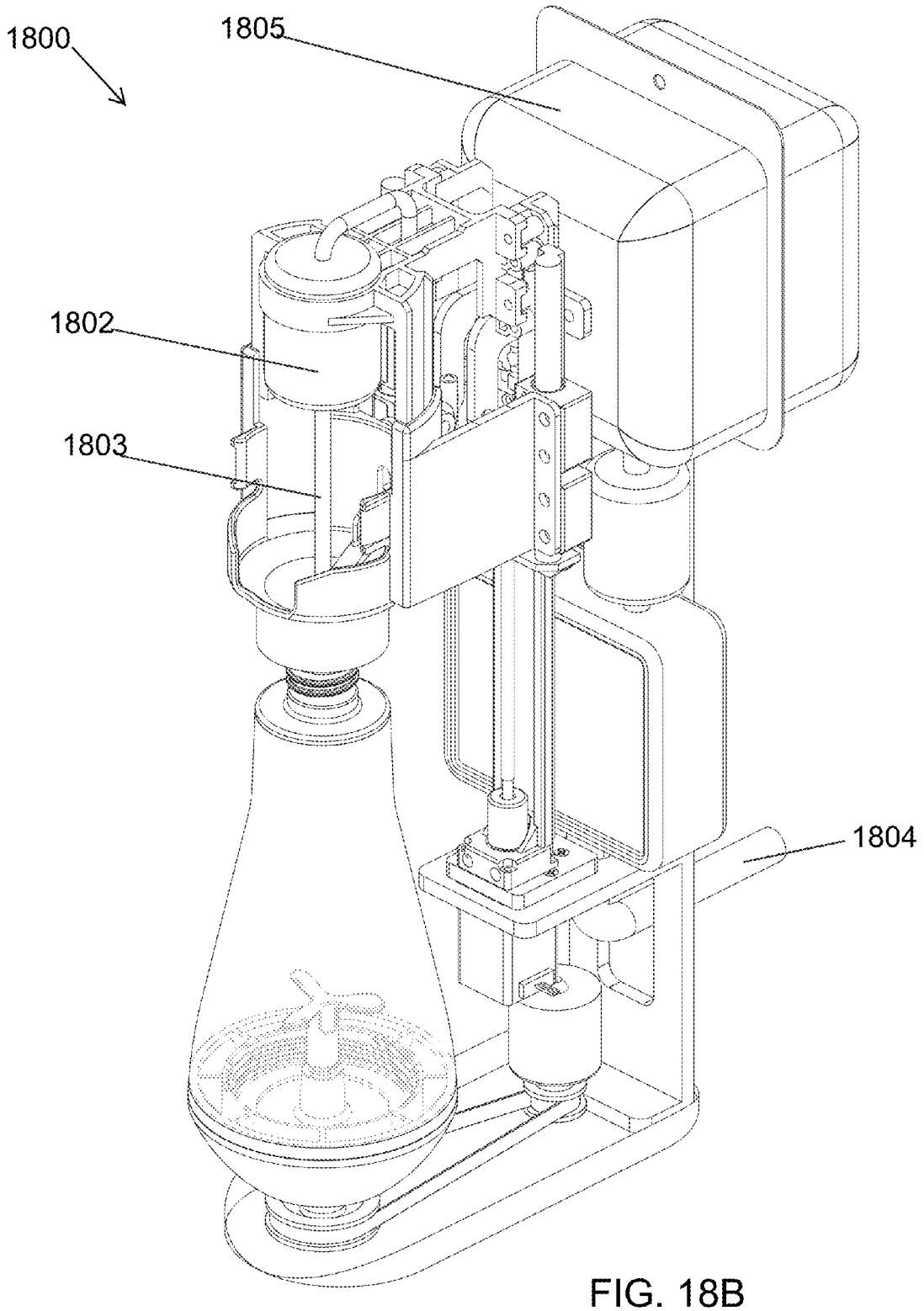
Figure 18C:
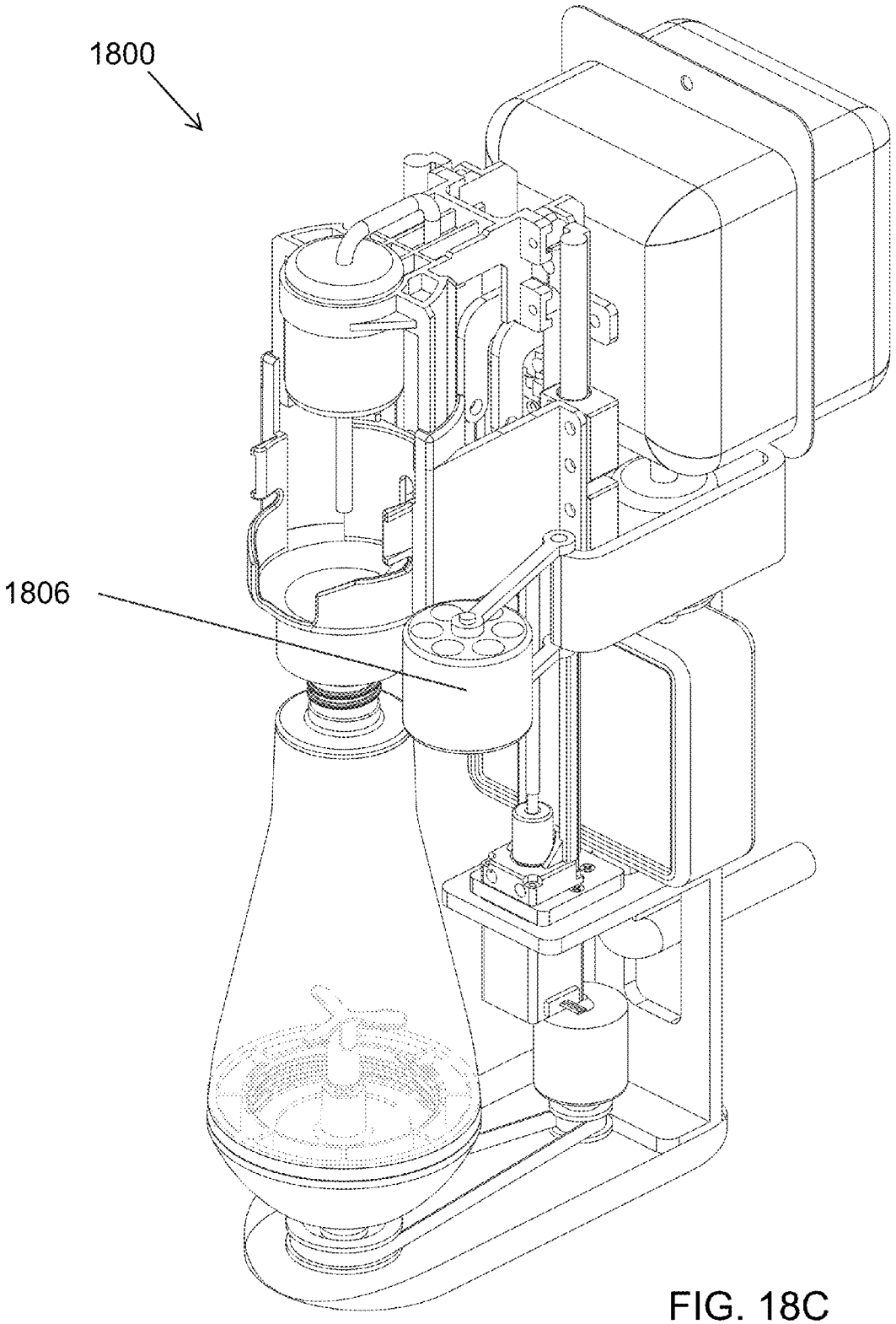
Figure 18D:
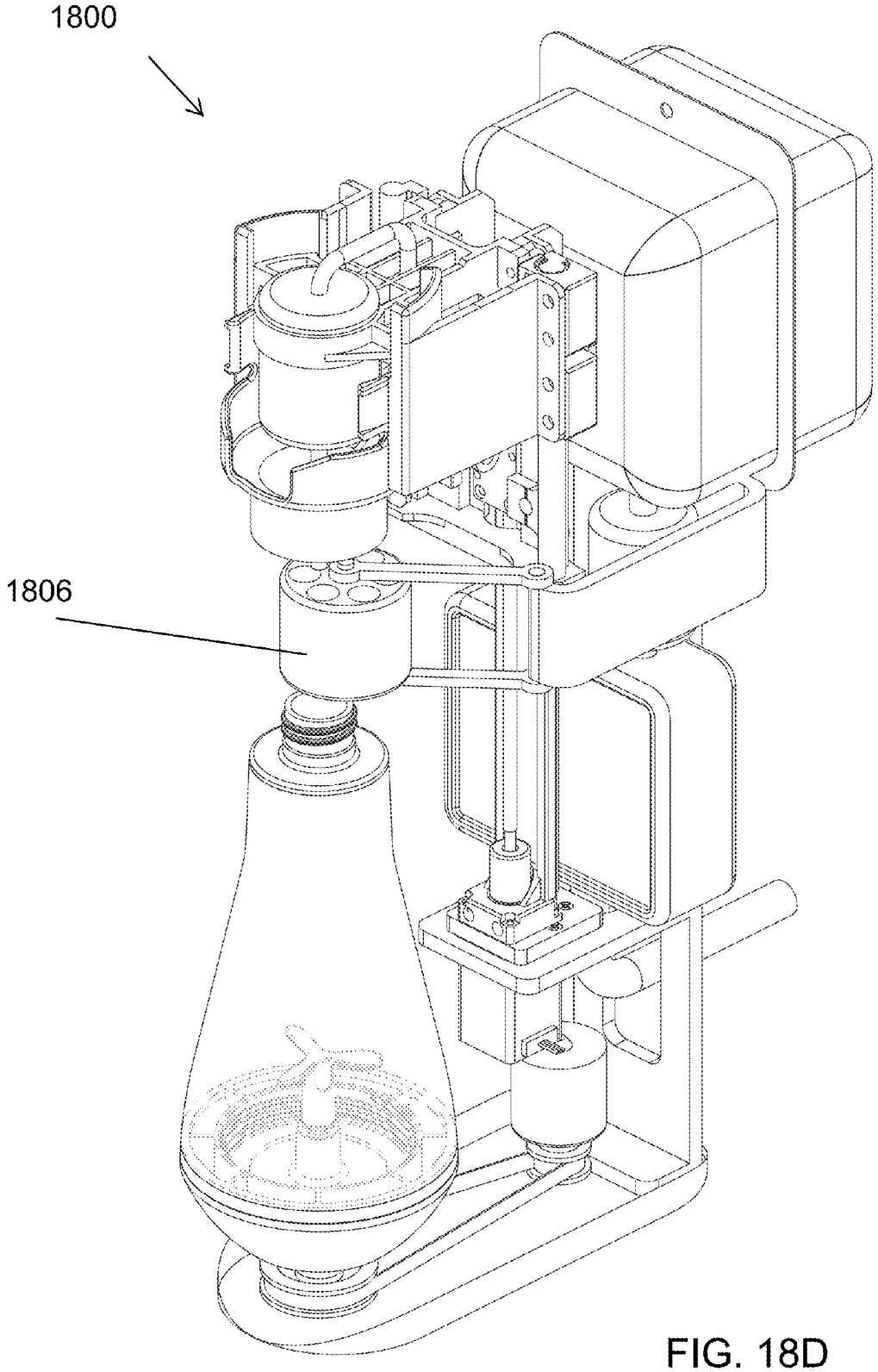

As shown in FIGS. 18C-D the production unit 1800 can include an additive chamber 1806. In certain embodiments, the additive chamber 1806 can consist of one or more additive cartridges. The additives contained in such additive cartridges can be pumped through tubing from the additive cartridges directly into the mixing container.

In certain embodiments, the localized solution production unit 1800 can be configured for use in commercial or institutional facilities to mix larger batches of solution in correspondingly larger mixing containers. In these embodiments, the necessary concentrate volume will be higher and the higher amount may be regulated by concentrate dispenser pump 1802.

Figure 19B:
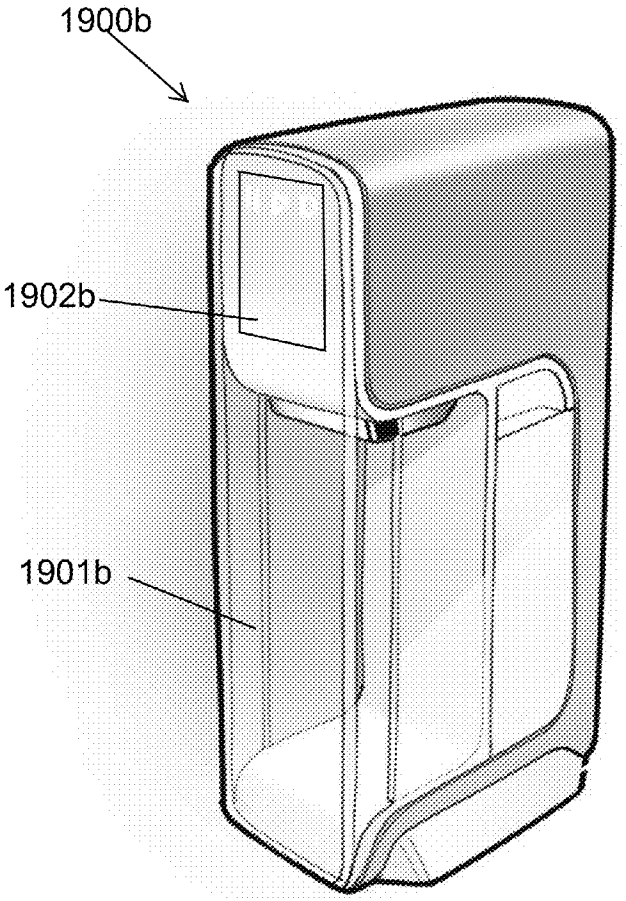
FIGS. 19A and 19B illustrate outer shells of localized solution production unit for producing a solution from a concentrate pod, in accordance with various embodiments.
Figure 19A:
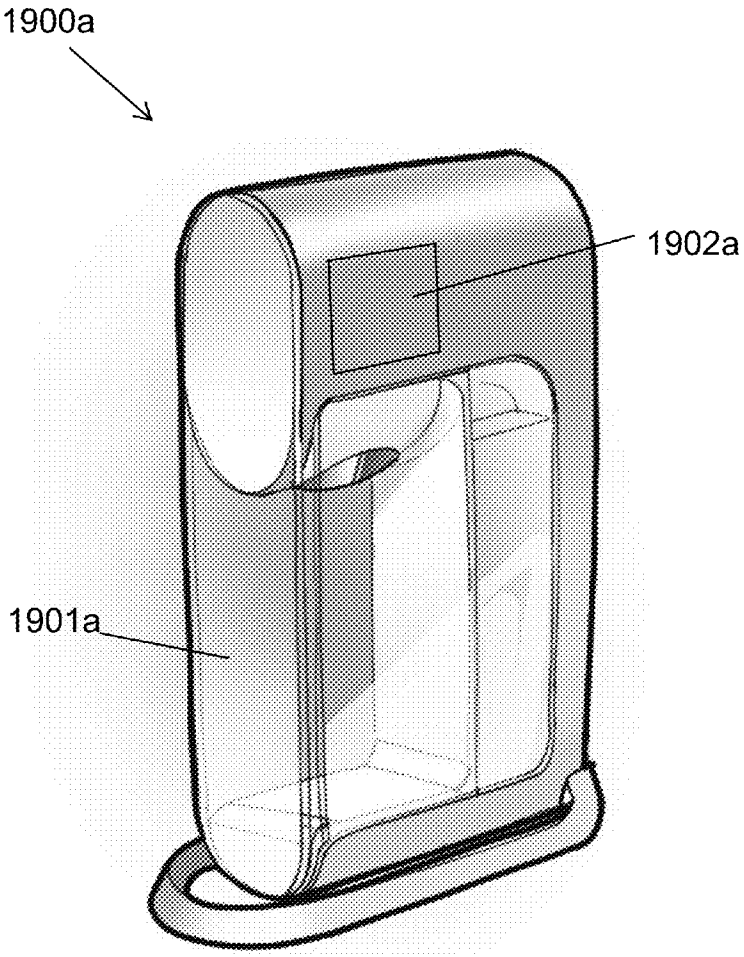

FIGS. 19A and 19B illustrate outer shells of localized solution production unit for producing a solution from a concentrate pod in accordance with various embodiments. The outer shell 1900*a* or 1900*b* can be used to house embodiments of the localized production units 100, 600, 700, and 800 described herein as demonstrated by way of example in FIGS. 20A-20C. The outer shells 1900*a* and 1900*b* include safety shields 1901*a* and 1901*b* respectively for safeguarding against potential pinch points that may arise when the pod dock adjusts to the height of a particular mixing container. A user interface 1902*a* and 1902*b* can be integrated into the outershields 1901*a* and 1901*b*.

Figure 20C:
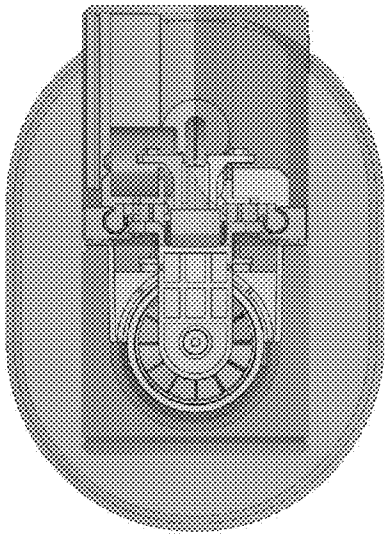
FIG. 20C is a top transparent view of a localized solution production unit housed in the outer shell of FIG. 19A.
Figure 20B:
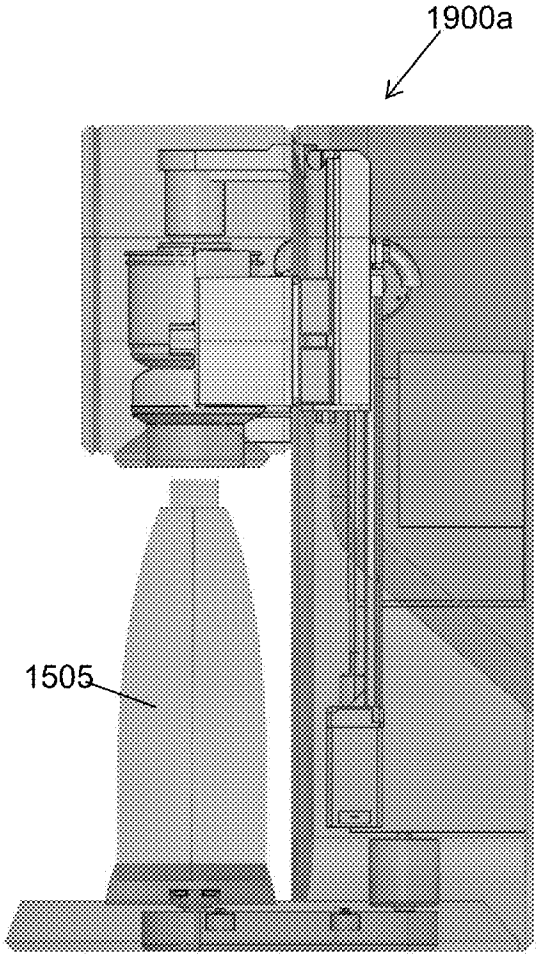
FIG. 20B is a side transparent view of a localized solution production unit housed in the outer shell of FIG. 19A.
Figure 20A:
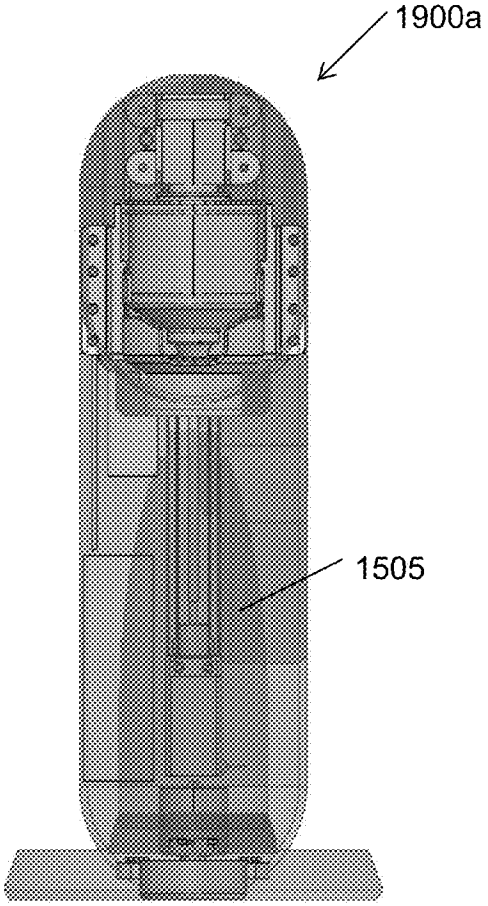
FIG. 20A is a front transparent view of a localized solution production unit housed in the outer shell of FIG. 19A.

FIG. 20A is a front transparent view of a localized solution production unit housed in the outer shell of FIG. 19A.

FIG. 20B is a side transparent view of a localized solution production unit housed in the outer shell of FIG. 18A.

FIG. 20C is a top transparent view of a localized solution production unit housed in the outer shell of FIG. 18A.

Figure 21:
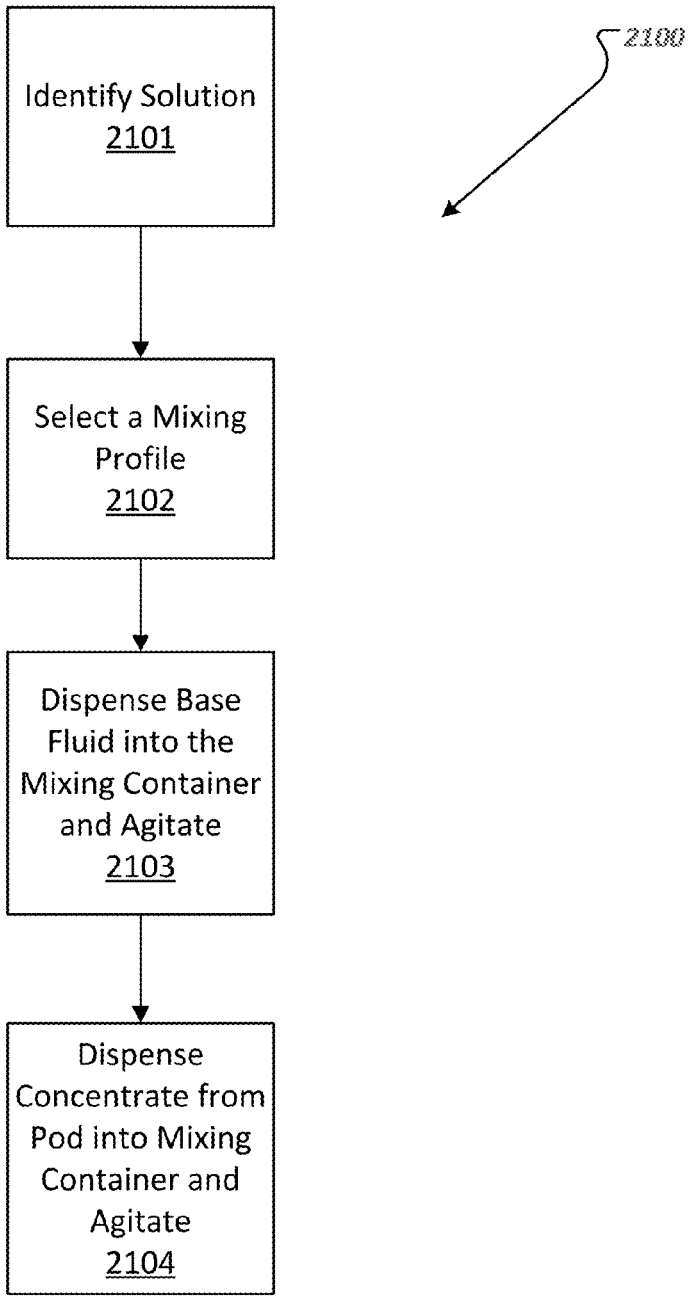
FIG. 21 shows a flow diagram illustrating operations of a localized solution production unit for producing a solution on demand from a concentrate pod.

FIG. 21 shows a flow diagram illustrating operations of a localized solution production unit for producing a solution on demand from a concentrate pod. The operations 2100 may be controlled via one or more controllers or processors electrically coupled to the localized production unit. At 2101, the controller identifies a solution. As discussed herein, the identity of the solution can be obtained from an identifier associated with a concentrate pod contained in a concentrate pod positioned in a pod dock of a localized solution production unit. The identity of the solution can be transmitted to the controller wirelessly over a server such as the internet or via wireless radio transmission (Bluetooth, Wi-Fi, etc.). The identity of the solution can also be received via a graphical user interface (GUI) of the localized solution production unit (e.g., a GUI on an outer shell as shown in FIGS. 19A and 19B). The controller identifies the characteristic(s) via a pod identification device (such as a detector, scanner, or reader 116 in the pod dock). At 2102, the controller selects a mixing profile from among a plurality of mixing profiles based on the solution identified and the associated mixing profile required to produce the particular solution. At 2103, the controller causes the localized production unit to dispense a base fluid into the mixing container and causes agitation of the base fluid based on the selected mixing profile. At 2104, the controller distributes the concentrate into a mixing container. The controller is configured to cause a particular agitation scheme (i.e., mixing duration/mixing time) to be implemented based on the mixing profile and may control one or more other parameters including, but not limited to, fluid temperature, flow rate and/or quantity of the base fluid(s), flow rate and/or quantity of the concentrate(s), and dispensing of additives based on the mixing profile. This agitation scheme can begin before the concentrate is distributed and after a particular amount of base fluid has been distributed. In certain embodiments, the controller can store information regarding the solutions produced, the time or date associated with such production, concentrate pods or additives used, and other information regarding operation of the production unit. This information can be transmitted to a remote server and analyzed to monitor user consumption data, to optimize communications with the user, and provide for ease of reordering.

Implementations of the subject matter and the operations described in this specification can be implemented by digital electronic circuitry, or via computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium for execution by, or to control the operation of, data processing apparatus.

A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., a FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's user device in response to requests received from the web browser.

Implementations of the subject matter described in this specification can be implemented in a computing system that includes a back end component, e.g., as a data server, or that includes a middleware component, e.g., an application server, or that includes a front end component, e.g., a user computer having a graphical display or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include users and servers. A user and server are generally remote from each other and typically interact through a communication network. The relationship of user and server arises by virtue of computer programs running on the respective computers and having a user-server relationship to each other. In some implementations, a server transmits data (e.g., an HTML page) to a user device (e.g., for purposes of displaying data to and receiving user input from a user interacting with the user device). Data generated at the user device (e.g., a result of the user interaction) can be received from the user device at the server.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

For the purpose of this disclosure, the term "coupled" means the joining of two members directly or indirectly to one another. Such joining may be stationary or movable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ in other exemplary implementations, and that such variations are intended to be encompassed by the present disclosure. It is recognized that features of the disclosed implementations can be incorporated into other disclosed implementations.

While various inventive implementations have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive implementations described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive implementations described herein. It is, therefore, to be understood that the foregoing implementations are presented by way of example only and that, within the scope of the appended claims and equivalents thereto, inventive implementations may be practiced otherwise than as specifically described and claimed. Inventive implementations of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way. Accordingly, implementations may be constructed in which acts are performed in an order different than illustrated, which may include performing some acts simultaneously, even though shown as sequential acts in illustrative implementations.

The claims should not be read as limited to the described order or elements unless stated to that effect. It should be understood that various changes in form and detail may be made by one of ordinary skill in the art without departing from the spirit and scope of the appended claims. All implementations that come within the spirit and scope of the following claims and equivalents thereto are claimed.

What is claimed is:

1. A localized solution production unit for producing a solution from a concentrate pod comprising:

a mixing container including a mixing impeller rotatably coupled to the container via an impeller shaft extending from a base of the mixing container, the mixing container including an opening at a neck of the container;

a pod dock configured to removably receive the concentrate pod, the pod dock including a dock outlet, the concentrate pod including a sealable spout portion configured to be positioned in the dock outlet and extend therethrough, the sealable spout portion configured to release a concentrate from the concentrate pod into the mixing container, the pod dock configured to move the sealable spout portion of the concentrate pod into the opening at the neck of the mixing container for a direct transfer of the concentrate from the concentrate pod into the mixing container;

a container dock coupled to the pod dock and configured to removably receive and engage the mixing container during a distribution of one or more of a base fluid flowing from a base fluid source and the concentrate released from the concentrate pod through the sealable spout portion of the concentrate pod, the container dock configured to retain the mixing container during a mixture of the base fluid and the concentrate, the container dock including an actuator and a rotatable coupling connected to the actuator, the rotatable coupling configured to rotatably actuate the impeller shaft to rotate the mixing impeller of the mixing container; and a controller communicably coupled to the actuator and the base fluid source, the controller configured to select a mixing profile from among a plurality of mixing profiles based on a solution identification, the controller configured to cause the actuator to rotate after the impeller is submerged by the distribution of the base fluid to generate a vortex in the mixing container prior to distribution of the concentrate and to mix the base fluid and the concentrate based on the selected mixing profile.

2. The localized solution production unit according to claim 1, wherein the pod dock includes one or more surfaces configured to move with respect to another surface of the pod dock to change a volume within the pod dock so as to squeeze the concentrate pod positioned in the pod dock and evacuate the concentrate from the concentrate pod.

3. The localized solution production unit according to claim 1, wherein the pod dock includes at least one roller configured to move in the pod dock to squeeze the concentrate pod positioned in the pod dock and evacuate the concentrate from the concentrate pod.

4. The localized solution production unit according to claim 1, further comprising a plunger configured to slide in the pod dock to press the concentrate from the concentrate pod.

5. The localized solution production unit according to claim 1, further comprising a user interface configured to receive an input providing the solution identification.

6. The localized solution production unit according to claim 1, wherein the controller is configured to vary a mixing speed based on the solution identification.

7. The localized solution production unit according to claim 1, further comprising a height adjustable platform coupling the pod dock to the container dock for adjusting a distance between the pod dock and the container dock.

8. The localized solution production unit according to claim 7, wherein the controller is configured to adjust the height adjustable platform based on the height of the mixing container positioned in the container dock.

9. The localized solution production unit according to claim 1, wherein the controller is configured to control at least one of a fluid temperature of the base fluid, fluid quantity of the base fluid, fluid flow rate of the base fluid, and mixing duration, based on the solution identification.

10. The localized solution production unit according to claim 1, further comprising a heating element configured to heat the base fluid.

11. The localized solution production unit according to claim 1, further comprising a scanner in the pod dock configured to scan a code on the concentrate pod.

12. The localized solution production unit according to claim 1, wherein the concentrate pod includes an electronic tag providing the solution identification.

13. The localized solution production unit according to claim 12, further comprising an electronic tag detection unit in the pod dock configured to detect the electronic tag on the concentrate pod.

14. The localized solution production unit according to claim 1, wherein the fluid source includes a fluid reservoir coupled to the pod dock, the fluid reservoir coupled to a pump configured to pump the base fluid from the fluid reservoir to the mixing container.

15. The localized solution production unit according to claim 1, further comprising one or more additive chambers configured to dispense an additive positioned in the one or more additive chambers into the mixing container.

16. The localized solution production unit according to claim 15, wherein the controller is configured to cause the one or more additive chambers to release at least one additive selected from a plurality of additives positioned in the one or more additive chambers into the mixing container.

17. A localized solution production unit for producing a solution from a concentrate pod comprising:

a mixing container including a mixing impeller rotatably coupled to the mixing container via an impeller shaft extending from a base of the mixing container, the mixing container including an opening at a neck of the mixing container;

a pod dock configured to removably receive the concentrate pod, the pod dock including a dock outlet, the concentrate pod including a sealable spout portion configured to be positioned in the dock outlet and extend therethrough, the sealable spout portion configured to release a concentrate from the concentrate pod into the mixing container;

a container dock coupled to the pod dock and configured to removably receive and engage the mixing container during a distribution of one or more of a base fluid flowing from a base fluid source and the concentrate released from the concentrate pod through the sealable spout portion of the concentrate pod, the container dock configured to retain the mixing container during a mixture of the base fluid and the concentrate, the container dock including an actuator and a rotatable coupling connected to the actuator, the rotatable coupling configured to rotatably actuate the impeller shaft to rotate the mixing impeller; and a controller communicably coupled to the actuator and the base fluid source, the controller configured to select a mixing profile from among a plurality of mixing profiles based on a solution identification, the controller configured to cause the actuator to rotate the impeller to generate a vortex for mixing the base fluid and the concentrate based on the selected mixing profile, wherein at least one of the pod dock and the container dock are configured to move with respect to one another so as to position the sealable spout portion into the opening at the neck of the mixing container to allow direct transfer of the concentrate from the concentrate pod into the mixing container.

18. The localized solution production unit according to claim 17, further comprising one or more additive chambers configured to dispense an additive positioned in the one or more additive chambers into the mixing container.

19. A localized solution production unit for producing a solution comprising:

a mixing container including a mixing impeller rotatably coupled to the mixing container via an impeller shaft extending from a base of the mixing container, the mixing container including an opening at a neck of the mixing container;

a concentrate container;

a concentrate spout coupled to the concentrate container, the concentrate spout configured to release a concentrate from the concentrate container into the mixing container;

a container dock coupled to the concentrate container and configured to removably receive and engage the mixing container during a distribution of one or more of a base fluid flowing from a base fluid source and the concentrate released from the concentrate container, the container dock configured to retain the mixing container during a mixture of the base fluid and the concentrate, the container dock including an actuator and a rotatable coupling connected to the actuator, the rotatable coupling configured to rotatably actuate the impeller shaft to rotate the mixing impeller; and a controller communicably coupled to the actuator and the base fluid source, the controller configured to select a mixing profile from among a plurality of mixing profiles based on a solution identification, the controller configured to cause the actuator to rotate the impeller to generate a vortex for mixing the base fluid and the concentrate based on the selected mixing profile, wherein the container dock is configured to move with respect to the concentrate spout so as to position the concentrate spout into the opening at the neck of the mixing container to allow direct transfer of the concentrate from the concentrate container into the mixing container.

20. The localized solution production unit according to claim 19, further comprising a pump coupled to the concentrate container to pump the concentrate from the concentrate container through the concentrate spout.

21. The localized solution production unit according to claim 19, wherein the controller is configured to actuate the actuator to rotate the mixing impeller in response to dispensing of a pre-specified volume of the base fluid.

22. The localized solution production unit according to claim 1, further comprising the concentrate pod.

23. The localized solution production unit according to claim 22, wherein the concentrate pod is positioned in the pod dock.

24. The localized solution production unit according to claim 1, further comprising an optical sensor configured to sense a height of the mixing container.

25. The localized solution production unit according to claim 1, further comprising at least one pressure sensor positioned on the pod dock.

26. The localized solution production unit according to claim 1, further comprising at least one capacitive touch sensor positioned on the pod dock.

27. The localized solution production unit according to claim 1, further comprising at least one sensor configured to detect submerging of the impeller by the distribution of the base fluid.

28. The localized solution production unit according to claim 1, wherein the mixing container includes a tag and wherein the localized solution production unit comprises a detection unit configured to read the tag on the mixing container.

29. The localized solution production unit according to claim 28, wherein the tag identifies at least one of a height and a volume of the mixing container.

30. A localized solution production unit for producing a solution from a concentrate pod comprising:

a mixing container including a mixing impeller rotatably coupled to the mixing container via an impeller shaft extending from a base of the mixing container, the mixing container including an opening at a neck of the mixing container;

a pod dock configured to removably receive the concentrate pod, the pod dock including a dock outlet, the concentrate pod including a sealable spout portion configured to be positioned in the dock outlet and extend therethrough, the sealable spout portion configured to release a concentrate from the concentrate pod into the mixing container, the pod dock including at least one roller configured to move in the pod dock to squeeze the concentrate pod positioned in the pod dock and evacuate the concentrate from the concentrate pod;

a container dock coupled to the pod dock and configured to removably receive and engage the mixing container during a distribution of one or more of a base fluid flowing from a base fluid source and the concentrate released from the concentrate pod through the sealable spout portion of the concentrate pod, the container dock configured to retain the mixing container during a mixture of the base fluid and the concentrate, the container dock including an actuator and a rotatable coupling connected to the actuator, the rotatable coupling configured to rotatably actuate the impeller shaft to rotate the mixing impeller; and a controller communicably coupled to the actuator and the base fluid source, the controller configured to select a mixing profile from among a plurality of mixing profiles based on a solution identification, the controller configured to cause the actuator to rotate the impeller to generate a vortex for mixing the base fluid and the concentrate based on the selected mixing profile.

31. The localized solution production unit according to claim 30, further comprising a user interface configured to receive an input providing the solution identification.

32. The localized solution production unit according to claim 30, wherein the controller is configured to vary a mixing speed based on the solution identification.

33. The localized solution production unit according to claim 30, further comprising a height adjustable platform coupling the pod dock to the container dock for adjusting a distance between the pod dock and the container dock.

34. The localized solution production unit according to claim 33, wherein the controller is configured to adjust the height adjustable platform based on the height of the mixing container positioned in the container dock.

35. The localized solution production unit according to claim 30, wherein the pod dock is configured to move the sealable spout portion of the concentrate pod into the opening at the neck of the mixing container for a direct transfer of the concentrate from the concentrate pod into the mixing container.

36. The localized solution production unit according to claim 30, wherein the controller is configured to control at least one of a fluid temperature of the base fluid, fluid quantity of the base fluid, fluid flow rate of the base fluid, and mixing duration, based on the solution identification.

37. The localized solution production unit according to claim 30, further comprising a heating element configured to heat the base fluid.

38. The localized solution production unit according to claim 30, further comprising a scanner in the pod dock configured to scan a code on the concentrate pod.

39. The localized solution production unit according to claim 30, wherein the concentrate pod includes an electronic tag providing the solution identification.

40. The localized solution production unit according to claim 39, further comprising an electronic tag detection unit in the pod dock configured to detect the electronic tag on the concentrate pod.

41. The localized solution production unit according to claim 30, wherein the fluid source includes a fluid reservoir coupled to the pod dock, the fluid reservoir coupled to a pump configured to pump the base fluid from the fluid reservoir to the mixing container.

42. The localized solution production unit according to claim 30, further comprising one or more additive chambers configured to dispense an additive positioned in the one or more additive chambers into the mixing container.

43. The localized solution production unit according to claim 42, wherein the controller is configured to cause the one or more additive chambers to release at least one additive selected from a plurality of additives positioned in the one or more additive chambers into the mixing container.

44. The localized solution production unit according to claim 30, further comprising the concentrate pod.

45. The localized solution production unit according to claim 44, wherein the concentrate pod is positioned in the pod dock.

46. The localized solution production unit according to claim 30, further comprising an optical sensor configured to sense a height of the mixing container.

47. The localized solution production unit according to claim 30, further comprising at least one pressure sensor positioned on the pod dock.

48. The localized solution production unit according to claim 30, further comprising at least one capacitive touch sensor positioned on the pod dock.

49. The localized solution production unit according to claim 30, further comprising at least one sensor configured to detect submerging of the impeller by the distribution of the base fluid.

50. The localized solution production unit according to claim 30, wherein the mixing container includes a tag and wherein the localized solution production unit comprises a detection unit configured to read the tag on the mixing container.

51. The localized solution production unit according to claim 50, wherein the tag identifies at least one of a height and a volume of the mixing container.

* * * * *